US005931528A

United States Patent [19]

Shields

[11] Patent Number: 5,931,528

[45] Date of Patent: Aug. 3, 1999

[54] CHAIR WITH ARTICULATING TABLET AND INTERFACING TABLE

[75] Inventor: Michael R. Shields, Greensboro, N.C.

[73] Assignee: Steelcase Inc., Grand Rapids, Mich.

[21] Appl. No.: 09/124,510

[22] Filed: Jul. 29, 1998

Related U.S. Application Data

[62] Division of application No. 08/749,146, Nov. 14, 1996, Pat. No. 5,816,649.

[51] Int. Cl.[6] ..... A47B 39/00

[52] U.S. Cl. ..... 297/174; 297/162; 297/161

[58] Field of Search ..... 297/217.3, 164, 297/154, 155, 135, 160, 161, 162, 174, 173; 108/147, 146, 59, 103, 105, 106, 92–96, 150, 147.19; 248/188.5, 404

[56] References Cited

U.S. PATENT DOCUMENTS

| | | |
|---|---|---|
| D. 44,441 | 8/1913 | Frazer . |
| D. 102,971 | 1/1937 | Hale . |
| D. 167,595 | 8/1952 | Simmons . |
| 171,528 | 12/1875 | Musser . |
| 175,176 | 3/1876 | Sheldon . |
| D. 192,115 | 1/1962 | Ziegenfuss . |
| 258,354 | 5/1882 | Bell . |
| D. 316,639 | 5/1991 | Adler . |
| D. 349,824 | 8/1994 | Ball . |
| D. 352,851 | 11/1994 | Hosoe . |
| D. 352,852 | 11/1994 | Hosoe . |
| 533,032 | 1/1895 | Breed . |
| 609,592 | 8/1898 | Shultz . |
| 854,298 | 5/1907 | Matthews . |
| 939,623 | 11/1909 | Payne et al. . |
| 951,145 | 3/1910 | McGenniss . |
| 1,324,503 | 12/1919 | Hirsch . |
| 1,391,222 | 9/1921 | Fleet . |
| 1,634,929 | 7/1927 | Blitz et al. . |
| 1,648,717 | 11/1927 | Blitz et al. . |
| 1,659,572 | 2/1928 | Klemm . |
| 1,756,210 | 4/1930 | Racz . |
| 1,888,478 | 11/1932 | Steidl . |
| 2,386,739 | 10/1945 | Epworth . |
| 2,619,396 | 11/1952 | Fires . |
| 2,671,631 | 3/1954 | Fox . |
| 2,746,526 | 5/1956 | Loeschnigg et al. . |
| 2,765,025 | 10/1956 | Bakalic et al. . |
| 3,029,106 | 4/1962 | McGuire . |
| 3,086,818 | 4/1963 | Panton . |
| 3,179,071 | 4/1965 | Johnston . |
| 3,342,147 | 9/1967 | Shettles . |
| 3,361,508 | 1/1968 | Chassevent . |
| 3,408,104 | 10/1968 | Raynes . |
| 3,479,084 | 11/1969 | Ryn . |
| 3,572,831 | 3/1971 | Barecki et al. . |
| 3,632,161 | 1/1972 | Arfaras et al. . |
| 4,169,625 | 10/1979 | Petersen . |

(List continued on next page.)

FOREIGN PATENT DOCUMENTS

| | | |
|---|---|---|
| 816467 | 7/1969 | Canada . |

*Primary Examiner*—Milton Nelson, Jr.
*Attorney, Agent, or Firm*—Price, Heneveld, Cooper, DeWitt & Litton

[57] ABSTRACT

A furniture system includes a chair with an articulateable tablet, and a table adapted to interface with the tablet. The chair tablet is supported by a support arm for articulated movement between a plurality of use positions in front of the chair, a side position generally beside the chair, and a vertical storage position generally below the side position and adjacent the chair. Additionally, the tablet is rotatable without translating the tablet so that it can be oriented in an optimal position relative to the table. The table includes a base adapted to stably engage a floor and a vertically adjustable tabletop. The chair tablet has a concavely shaped edge configured to abut and interface with a perimeter section of the tabletop. The chair is mounted on castors so that the chair is horizontally movable and rotatable to facilitate positioning the chair proximate the table, so that the chair and table can be manipulated to flexibly arrange a work surface with the size, shape, and location desired.

25 Claims, 20 Drawing Sheets

U.S. PATENT DOCUMENTS

| | | |
|---|---|---|
| 4,408,543 | 10/1983 | Griffin . |
| 4,591,206 | 5/1986 | Pribble . |
| 4,852,940 | 8/1989 | Kanigowski . |
| 4,861,102 | 8/1989 | Fuller . |
| 4,944,552 | 7/1990 | Harris . |
| 5,169,210 | 12/1992 | Fricano . |
| 5,231,562 | 7/1993 | Pierce et al. . |
| 5,237,935 | 8/1993 | Newhouse et al. . |
| 5,255,966 | 10/1993 | Newhouse et al. . |
| 5,282,671 | 2/1994 | Funk . |
| 5,421,271 | 6/1995 | Sui . |
| 5,438,937 | 8/1995 | Ball et al. . |
| 5,451,092 | 9/1995 | Gray . |
| 5,485,795 | 1/1996 | Williams . |
| 5,490,710 | 2/1996 | Dearing et al. . |

Fig. 18B
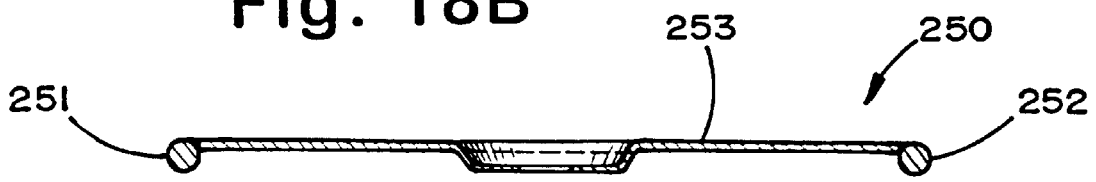
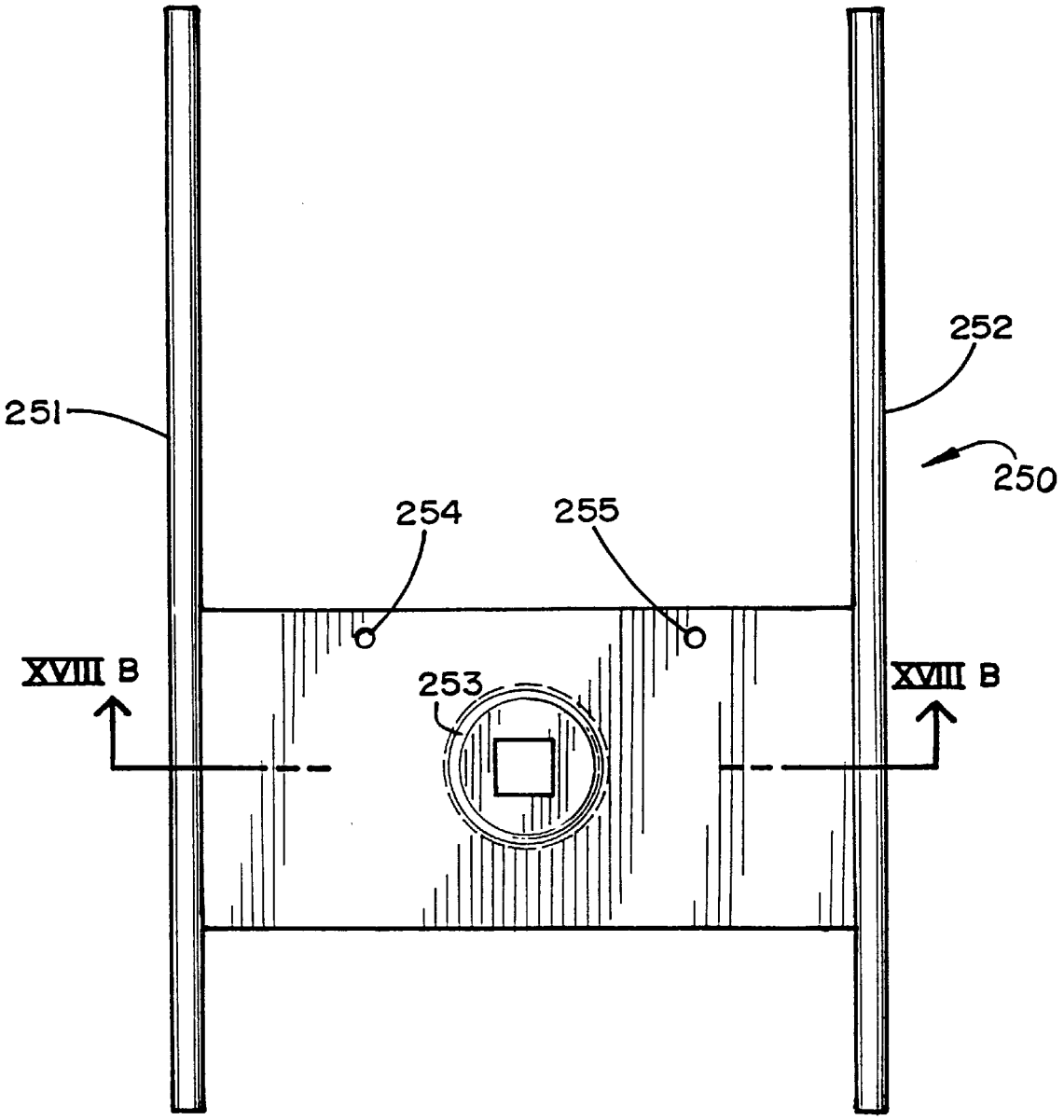
Fig. 18A

CHAIR WITH ARTICULATING TABLET AND INTERFACING TABLE

CROSS REFERENCE TO RELATED APPLICATIONS

The present application is a divisional of application Ser. No. 08/749,146, filed Nov. 14, 1996, entitled CHAIR WITH ARTICULATING TABLET AND INTERFACING TABLE, now U.S. Pat. No. 5,816,649, the entire contents of which is incorporated herein.

The present application is further related to the following coassigned applications, each having a common inventor:

| Application No. | U.S. Pat. No. | Filing Date | Title |
|---|---|---|---|
| 08/747,798 | 5,802,988 | November 14, 1996 | Vertically Adjustable Table |
| 29/064,102 | D 387,585 | November 14, 1996 | Table Design |
| 29/051,003 | D 385,423 | March 1, 1996 | Chair Design |

BACKGROUND OF THE INVENTION

The present invention concerns furniture having an articulating, storable tablet and a table adapted to interface with the tablet. The furniture is particularly adapted for supporting a computer in an optimal use position, although the present invention is not limited to only this use.

Increasing numbers of business people and travelers use portable computers while traveling in an effort to make productive use of time while waiting for flights or meetings. However, existing "public use" furniture at airports, reception areas, lobbies, and the like are not adapted to support such activities. Specifically, most existing "public use" furniture is not adapted to support a computer at a convenient work height and position. Part of the problem is that furniture for such public places must be both stylistic and very durable. Also, computer users characteristically work from a wide range of postural positions, such that it is difficult to design furniture flexible enough to meet each individual's needs while also meeting the functional and stylistic requirements of a "public use" environment.

Some existing chairs have trays that are supported for articulated movement between a storage position and a front position. However, the tray support mechanisms tend to be expensive, complex, and unattractive. Further, known trays and tray support mechanisms tend to be unsatisfactory and non-durable, such that if used in a "public use" environment where they are abused and used with a high frequency, the trays can become damaged and the mechanisms can become non-operative or unreliable. It is particularly important that a storable tablet for use in a furniture system adapted for use with computers be securely held when in its use position so that a computer rested thereon is not dropped.

Aside from the chair, tables are also needed that aesthetically and functionally complement chairs and that mate with chair trays. This allows the user to selectively expand their work surface area. It is noted that different tasks require different amounts of work surface areas, which is a considerable problem since space in public areas is often at a premium.

Accordingly, an apparatus is desired for solving the aforementioned problems and for providing a desired amount of style, functionality, and flexibility.

SUMMARY OF THE INVENTION

In one aspect of the present invention, a furniture system includes a chair having a tablet positionable in front of the chair, and a table having a work surface. The chair tablet has a contoured edge adapted to mateably interface with a perimeter section of the table. In narrower forms, the tablet is movable between a plurality of horizontal use positions, and/or the work surface is vertically adjustable.

In another aspect of the present invention, a furniture system includes a chair having a tablet translatably movable between a plurality of use positions around a front of the chair and also separately rotatably movable to different orientations with respect to the chair, the table having a contoured edge. The furniture system further includes a table having a tabletop with a perimeter section shaped to mateably engage the contoured edge so that, by positioning the chair adjacent the table with the contoured edge of the tablet engaging the perimeter section, an enlarged work surface area is formed.

In yet another aspect of the present invention, a method comprises steps of providing a chair with a movable tablet having a contoured edge, providing a table having a tabletop with a perimeter section shaped to mateably engage the contoured edge, and moving one of the chair and table to position the tablet adjacent the tabletop including engaging the contoured edge with the perimeter section.

These and other features and advantages of the present invention will be further understood and appreciated by those skilled in the art by reference to the following specification, claims, and appended drawings.

DESCRIPTION OF DRAWINGS

FIG. 18A is a plan view of the tablet reinforcement member for stiffening the tablet shown in FIG. 18;

FIG. 18B is a cross-sectional view taken along the line XVIIIB—XVIIIB in FIG. 18A;

DETAILED DESCRIPTION OF PREFERRED EMBODIMENT

Figure 1:
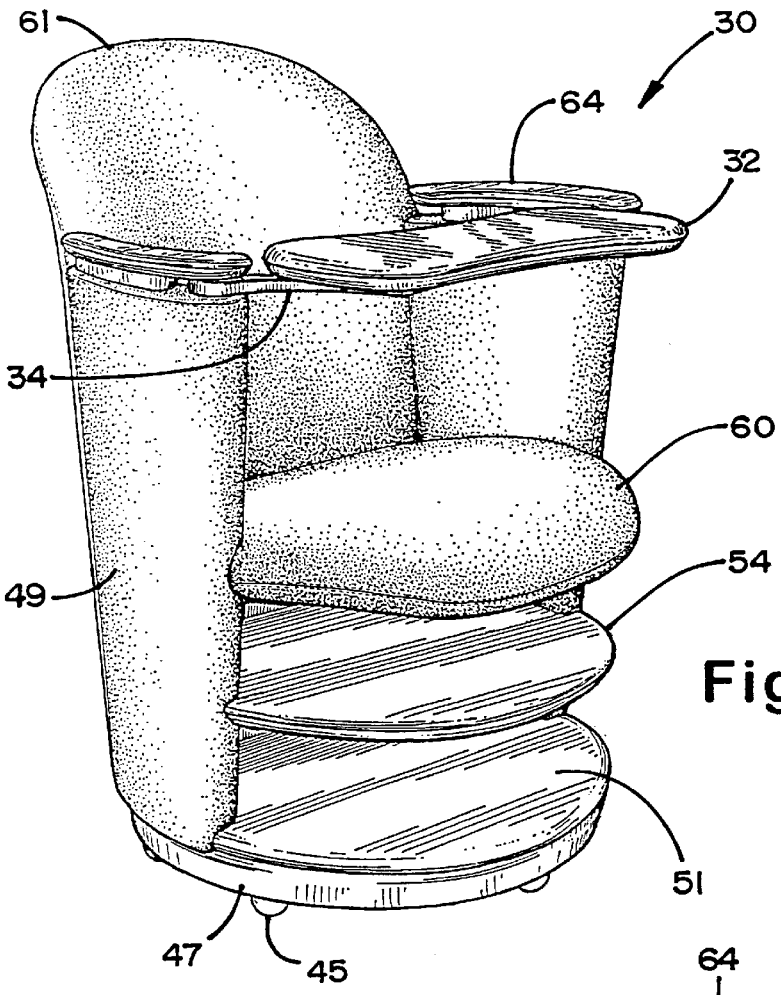
FIG. 1 is a perspective view of a chair embodying the present invention, the chair including a movable, storable tablet.
Figure 2:
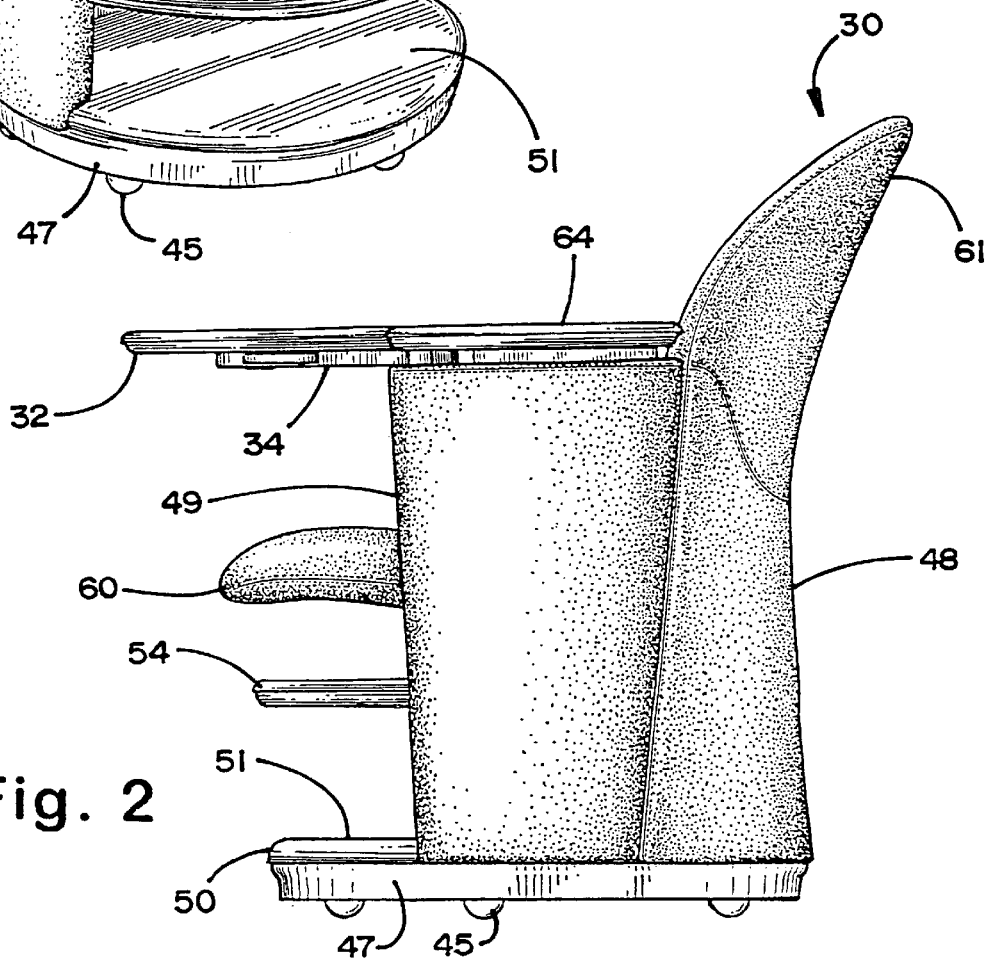
FIGS. 2–4 are side, front, and top views of the chair of FIG. 1, the tablet being shown in a front position for use.
Figure 3:
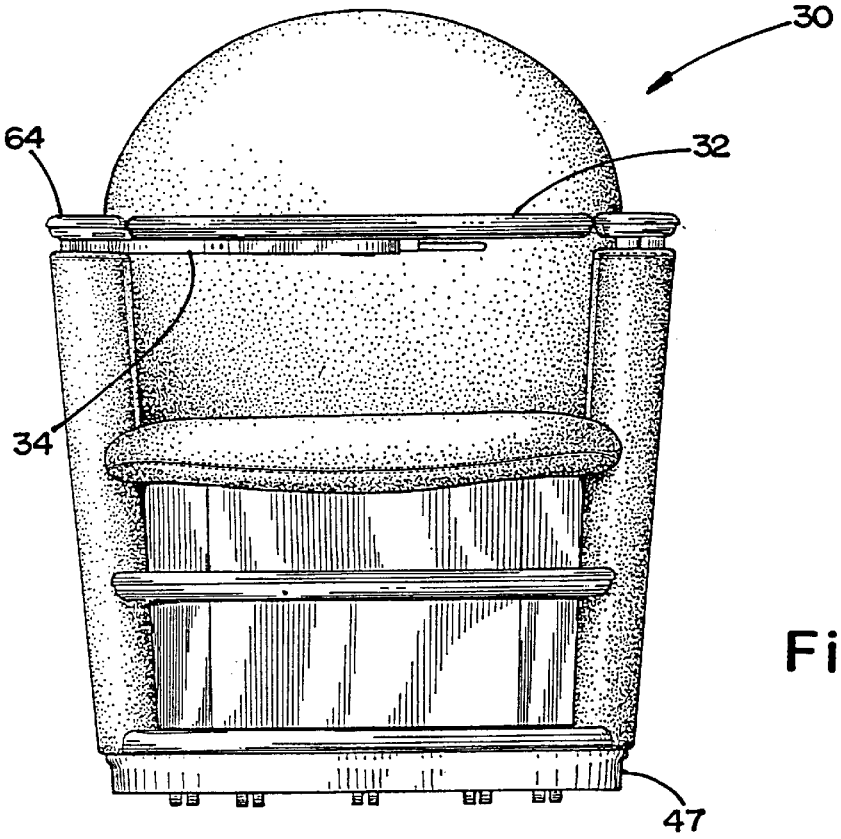
Figure 4:
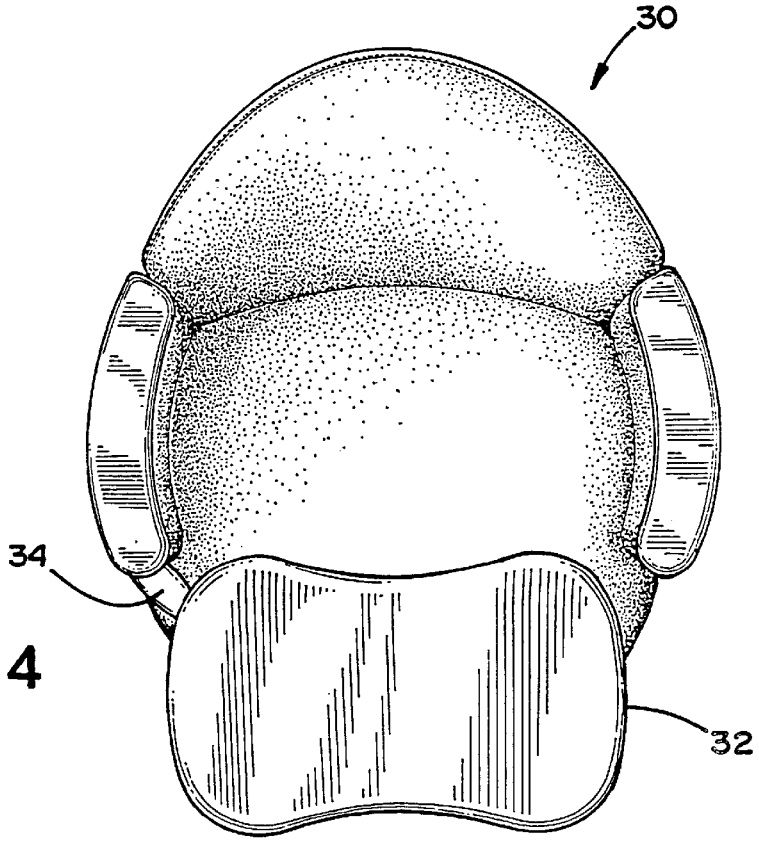
Figure 5:
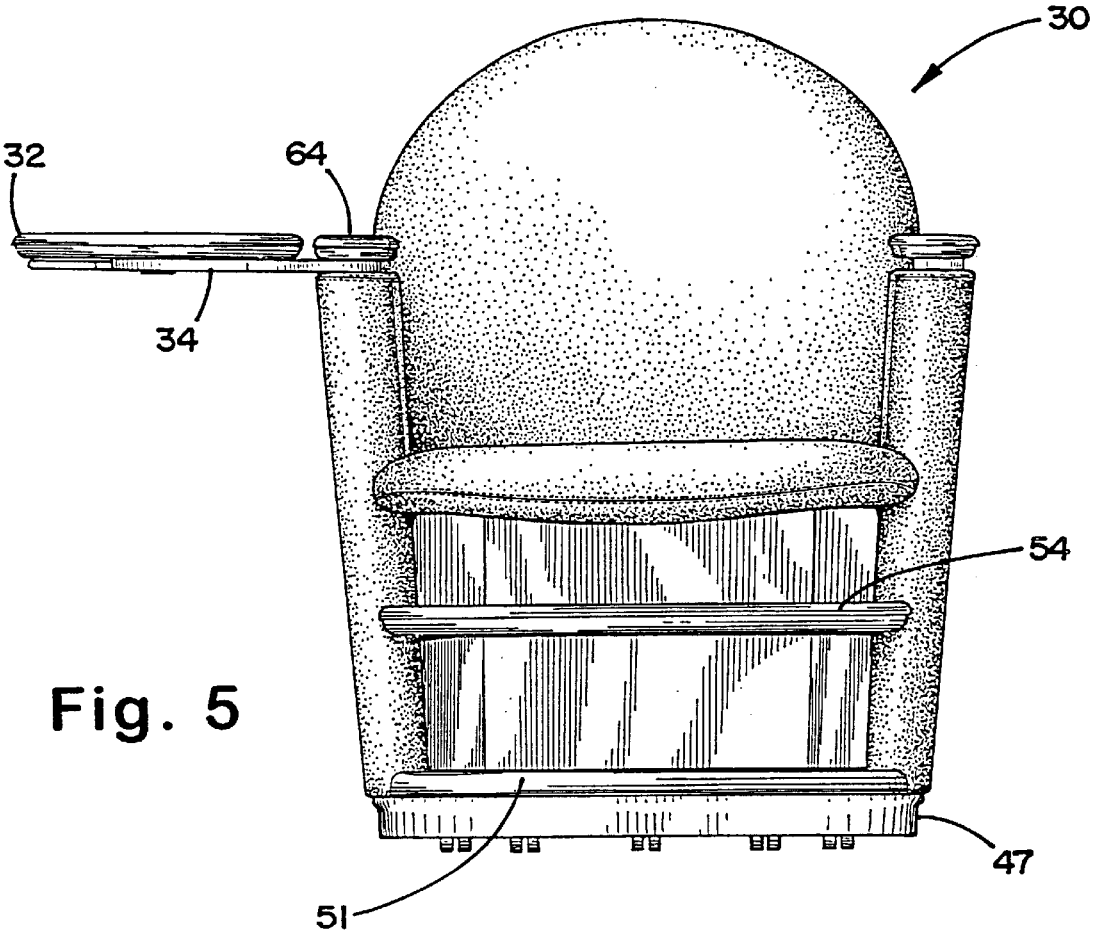
FIGS. 5 and 6 are front and top views of the chair of FIG. 1, the tablet being shown in a side position.
Figure 6:
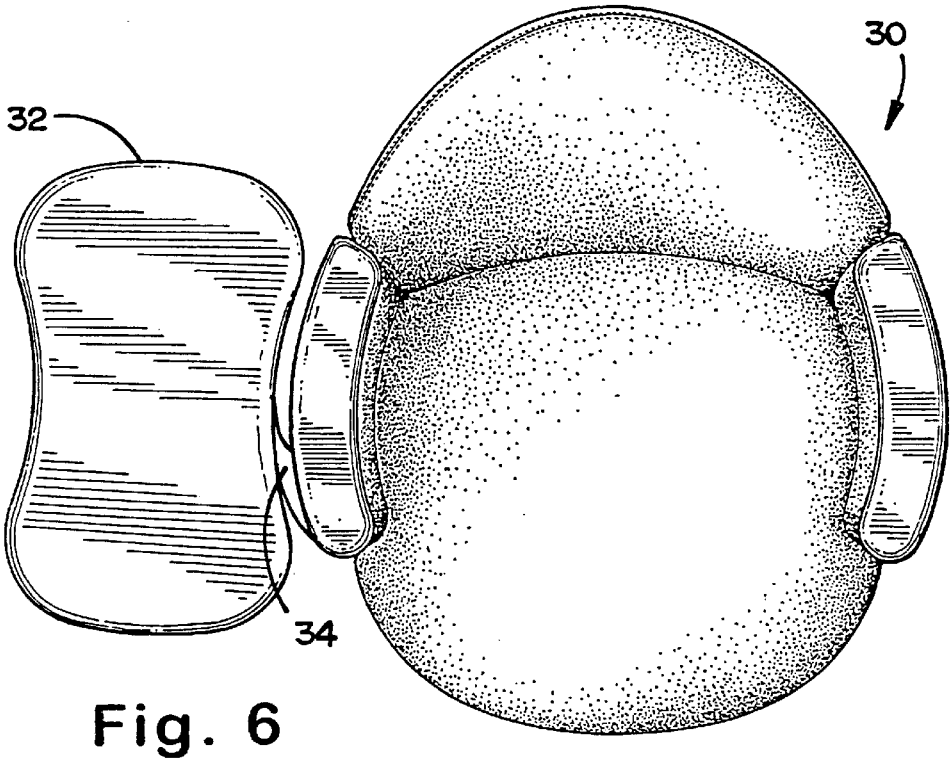
Figure 7:
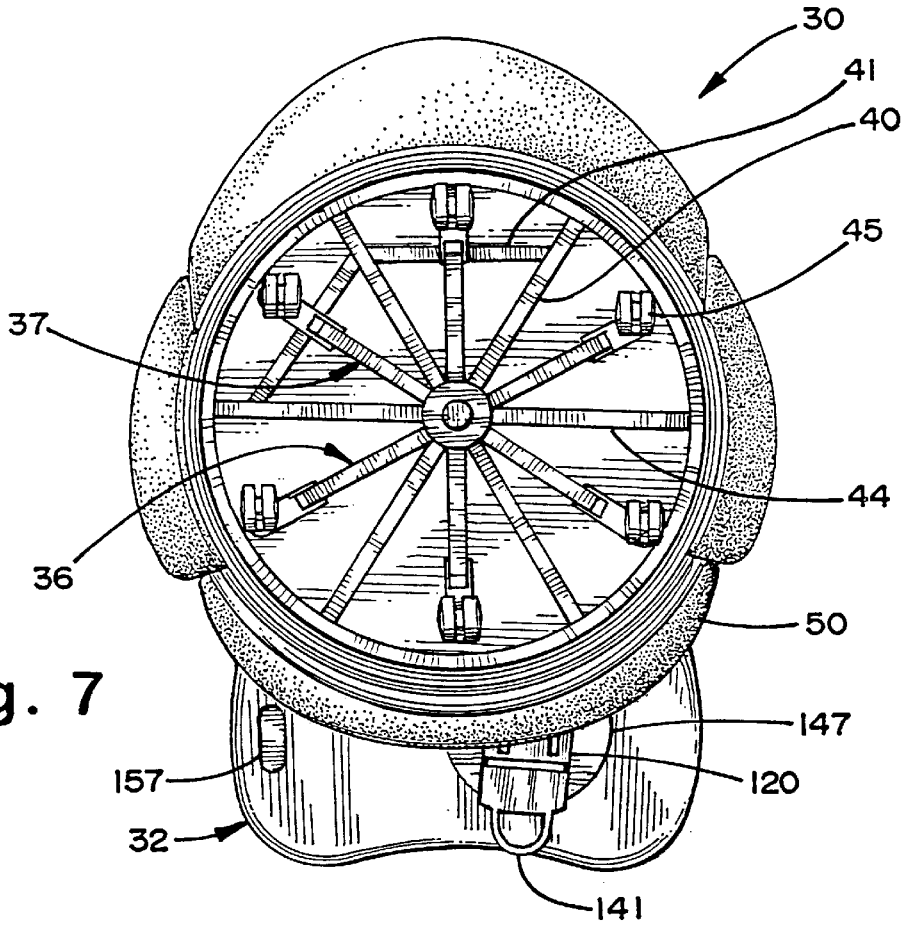
FIGS. 7 and 8 are bottom views of the chair shown in FIG. 1, the tablet being shown in a front position in FIG. 7 and in a side position in FIG. 8.
Figure 8:
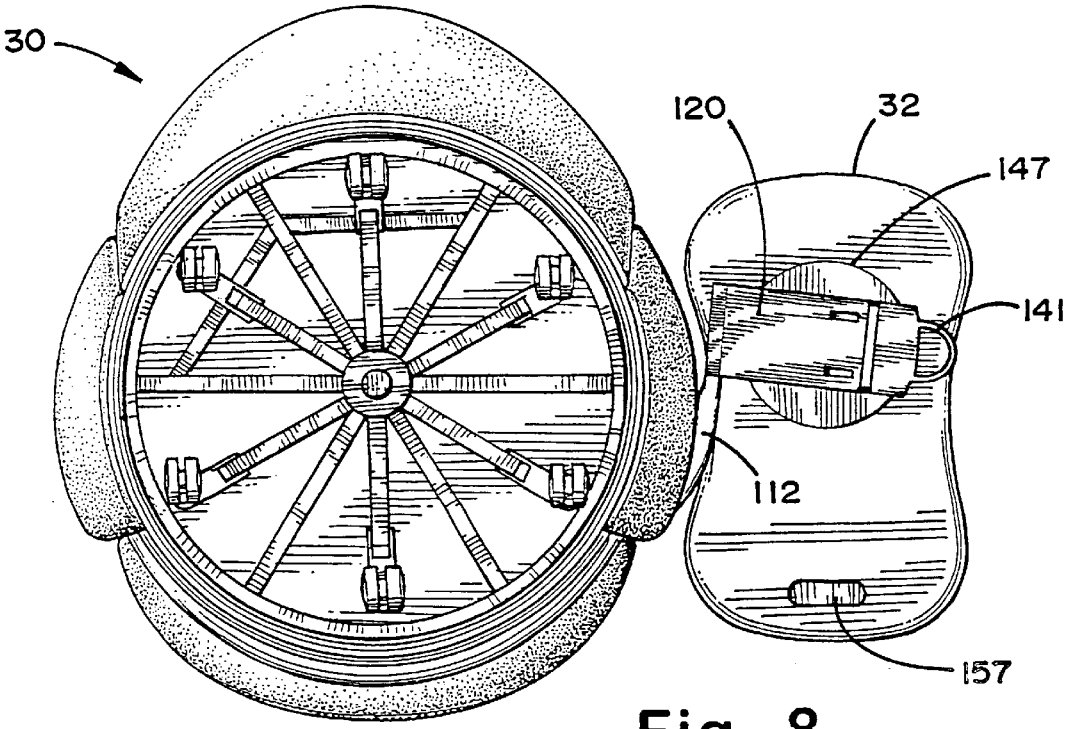
Figures 13, 16:
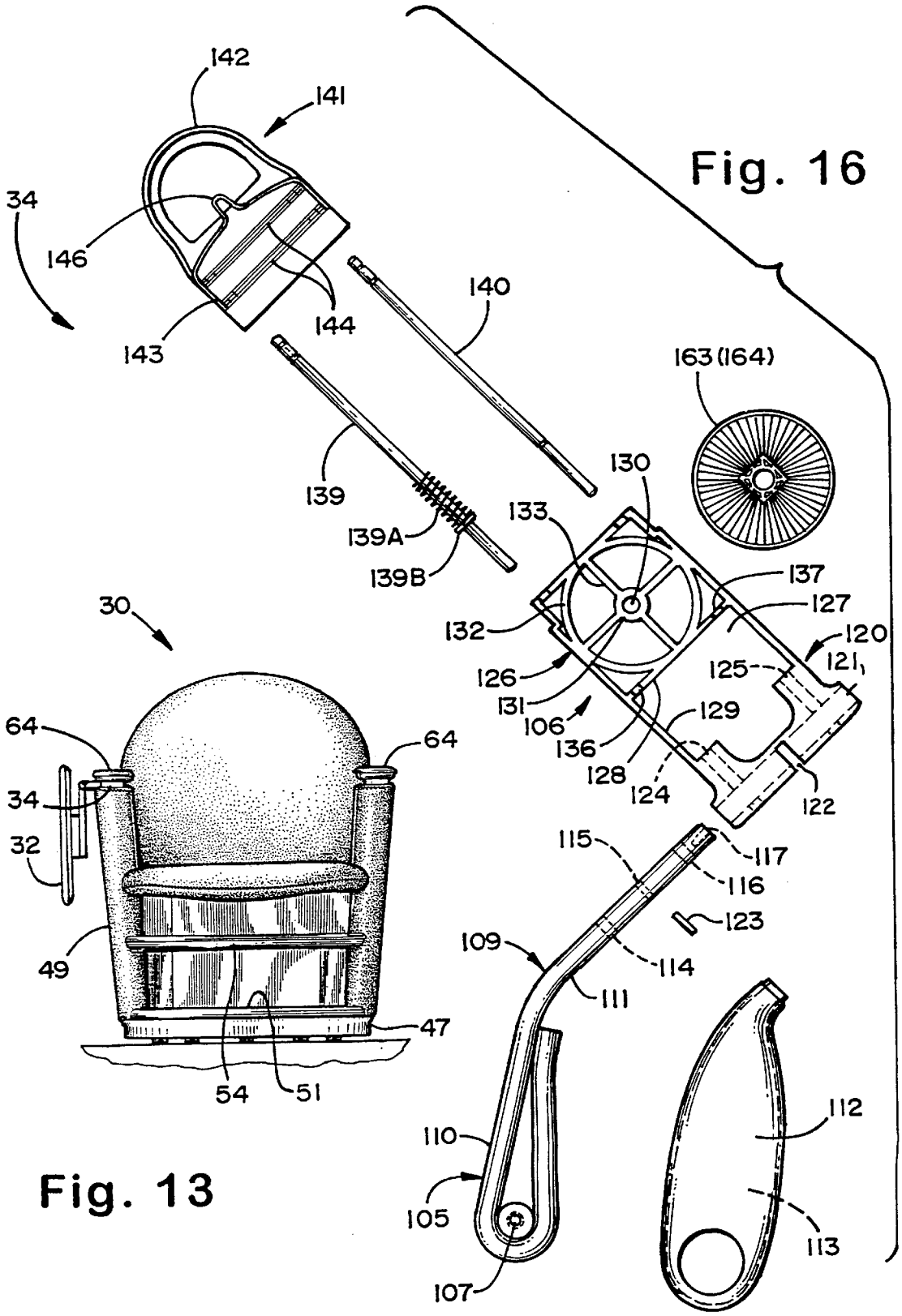
FIG. 13 is a front view of the chair shown in FIG. 1, the tablet being shown in a vertically folded position adjacent the chair seat.
FIG. 16 is an exploded plan view of the latching mechanism for the tablet shown in FIG. 14.
Figure 15:
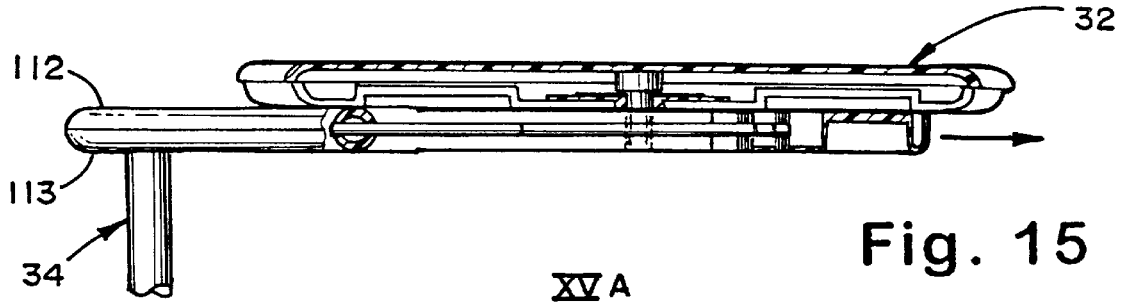
FIGS. 15 and 15A are cross-sectional views taken along the planes XV—XV and XVA—XVA in FIG. 14.

A furniture system embodying the present invention includes a mobile rotatable chair 30 (FIGS. 1–8) and a table 31 (FIGS. 19–22) adapted to interface with the chair 30 to provide a flexible work area. The chair 30 includes a tablet 32 movable between a plurality of front positions (FIGS. 1–4), a side position (FIGS. 5 and 6) and a vertically pivoted storage position (FIG. 13). The table 31 includes a height-adjustable tabletop 33 having a perimeter adapted to mateably abut and interface with the tablet 32. The tablet 32 is supported by a support arm 34 that is pivoted to the tablet 32 at one end and to the chair 30 at its other end, such that the tablet 32 articulatingly swings about two spaced-apart axes between and around the side and front of the chair 30 substantially to any desired position and orientation. The tabletop 33 is vertically adjustable, so that it can be raised to a position horizontally aligned with tablet 32. Alternatively, the tabletop 33 can be lowered below the tablet 33. The result is a flexible work surface for selectively supporting a computer and/or work product that can be arranged in a variety of configurations to satisfy specialized needs.

The chair 30 (FIG. 9) includes a seat assembly 35, and a base 36 for movably supporting seat assembly 35. Seat assembly 35 includes a bottom frame 37 having a center piece 38, an outer ring 39, and radially extending spoke-like reinforcements 40 for supporting outer ring 39 on center piece 38. Braces 41 are added as desired between reinforcements 40. Base 36 includes a hub 43 with radially extending legs 44. Castors 45 are operably attached to the outer ends of the legs 44. A protrusion 46 extends upwardly from hub 43 for rotatably engaging a hole in center piece 38. A skirt 47 attaches around outer ring 39 and drapes downwardly to cover the base 36. The seat assembly 35 is rotatable on base 36 as well as being rotatable and translatable on a floor, thus allowing the chair to be easily moved. Castors 45 can be designed to include a sufficient amount of friction to prevent undesired movement, but it is contemplated that the chair 30 will usually be used on a carpeted surface, such that undesired chair movement or creep will not be a problem.

Seat assembly 35 includes a semi-cylindrical back shell 48, and a pair of opposing armrest-forming side shells 49, each attached to a top of outer ring 39. Shells 48 and 49 include foam attached to steel inner frames. A footrest 50 is attached to a front of outer ring 39, and a bottom flat panel 51 is attached to a top of bottom frame 37 behind footrest 50. Flat panel 51 includes a rear edge 52 that is spaced inside of the outer ring 39, so that the shelf formed by bottom flat panel 51 is not so deep that it is difficult to reach completely to a back of the shelf. A back wall 53 is formed along the rear edge 52 and extends between the side shells 49. Back wall 53 extends upwardly to the bottom of the seat pan 57. A secondary shelf 54 (FIG. 5) similar to shelf/panel 51 is attached between the seat pan 55 and panel 51.

Seat pan 55 (FIG. 9) is supported by a pair of seat pan supporting brackets 56 and 57 that are attached to shells 48 and 49, one being positioned in front of back wall 53 and the other being positioned behind the back wall 53. Seat pan 55 includes a rigid ring 58 covered with a resilient webbing 59. The webbing 59 spans across an open interior of the ring 58. A seat cushion 60 is placed on the webbing 58, and then the assembly of the cushion 60 and ring 58 is covered with upholstery or fabric. A back extension shell 61 is attached to a top of the back shell 48. Optionally, the back extension shell 61 is spaced above the top of the back shell 48 by spacers 62 for aesthetics. Cushions, such as back extension shell 61A, are attached to shells 48, 49 and 61, and a covering of upholstery, fabric, leather, or other material is attached over the seat assembly 35 to form an attractive chair. Notably, a zipper 63 (FIG. 10) can be used along the center back seam to facilitate assembly. Armrests 64 are formed by attachment of opposing half members 64A and 64B (FIG. 9) to the top of side shells 49.

Figure 11:
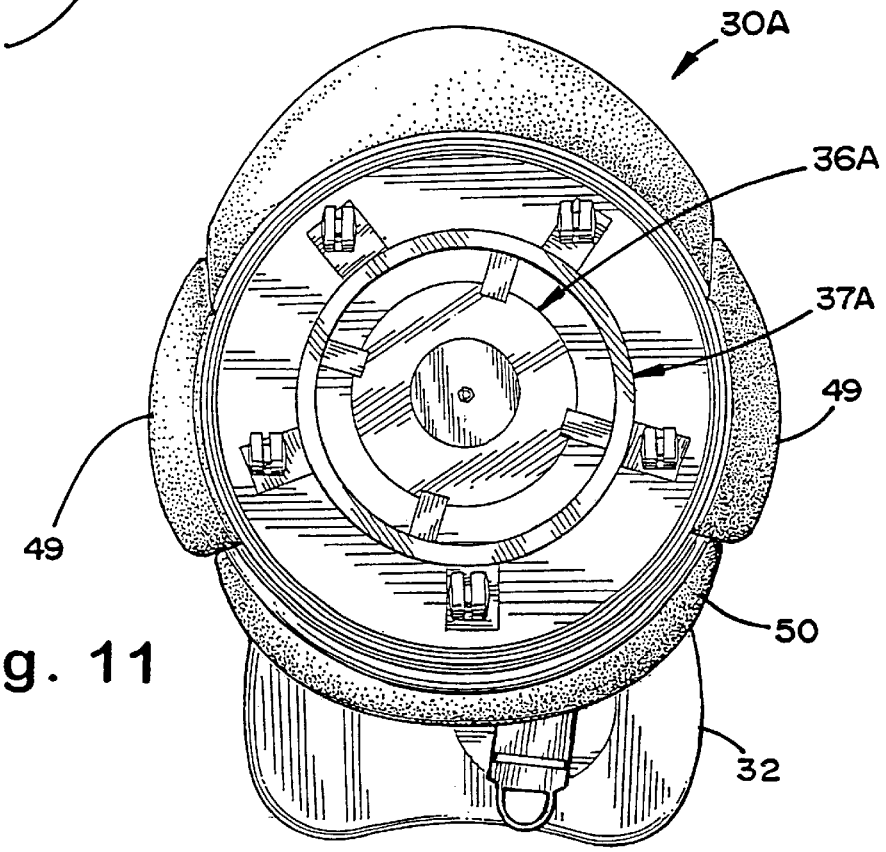
FIG. 11 is a bottom view of a modified chair embodying the present invention, the chair being similar to the chair of FIG. 1, but including a modified castored base.
Figure 12:
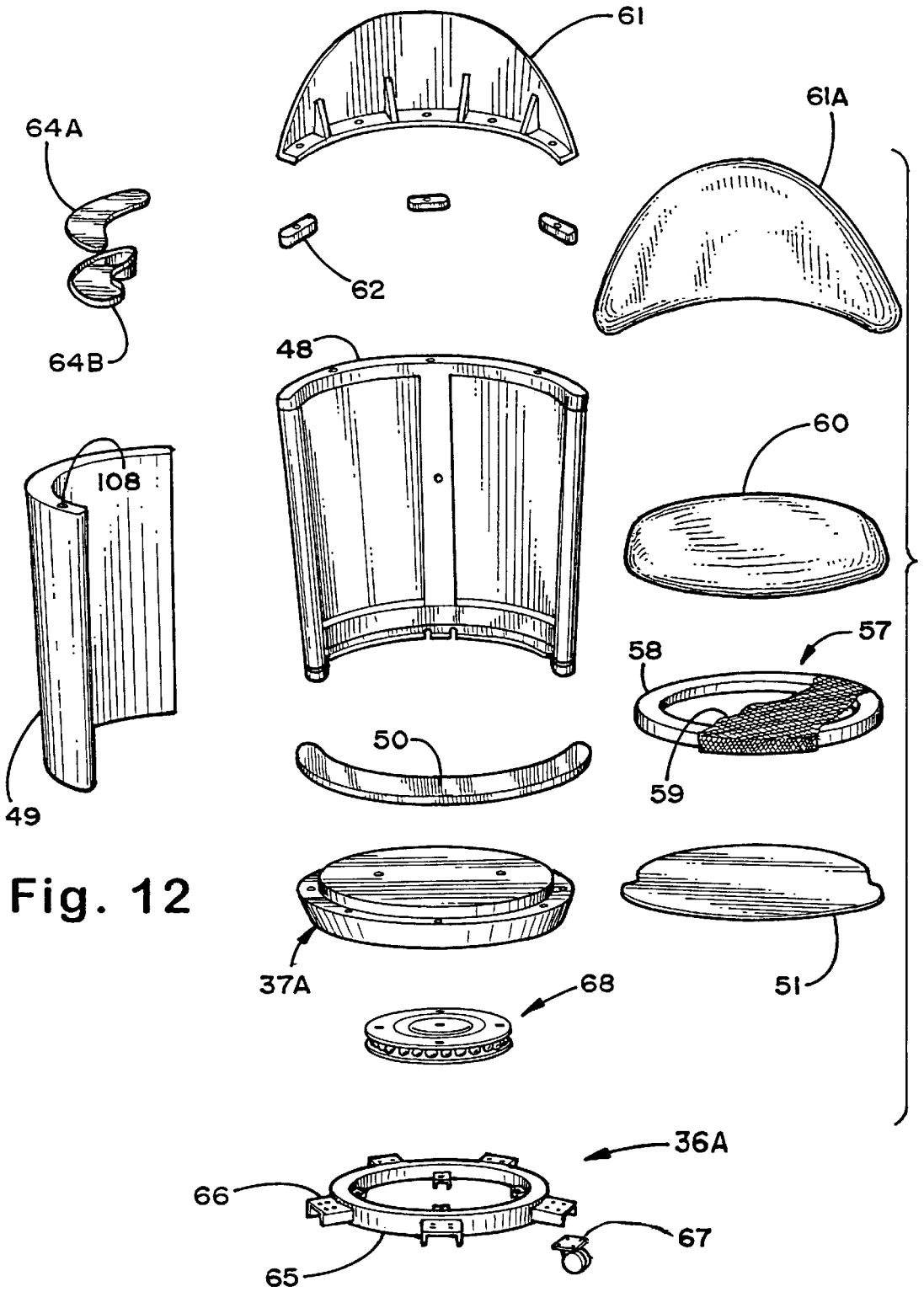
FIG. 12 is an exploded view of the chair shown in FIG. 11.

In a modified form, a chair 30A (FIGS. 11 and 12) includes components comparable to the chair 30, but chair 30A includes a modified base 36A and a modified bottom frame 37A. Bottom frame 37A (FIG. 12) comprises a solid disk, such as solid or cast material. The modified base 36A includes a ring frame 65 with castor-supporting platforms 66 radiating outwardly therefrom, castors 67 attached to the platforms 66, and a bearing plate assembly 68 for rotatably supporting base 36A on bottom frame 37A. The bearing plate assembly 68 includes a top plate attached to modified chair bottom frame 37A, a bottom plate attached to ring frame 65, and roller bearings between the two plates.

Figure 12A:
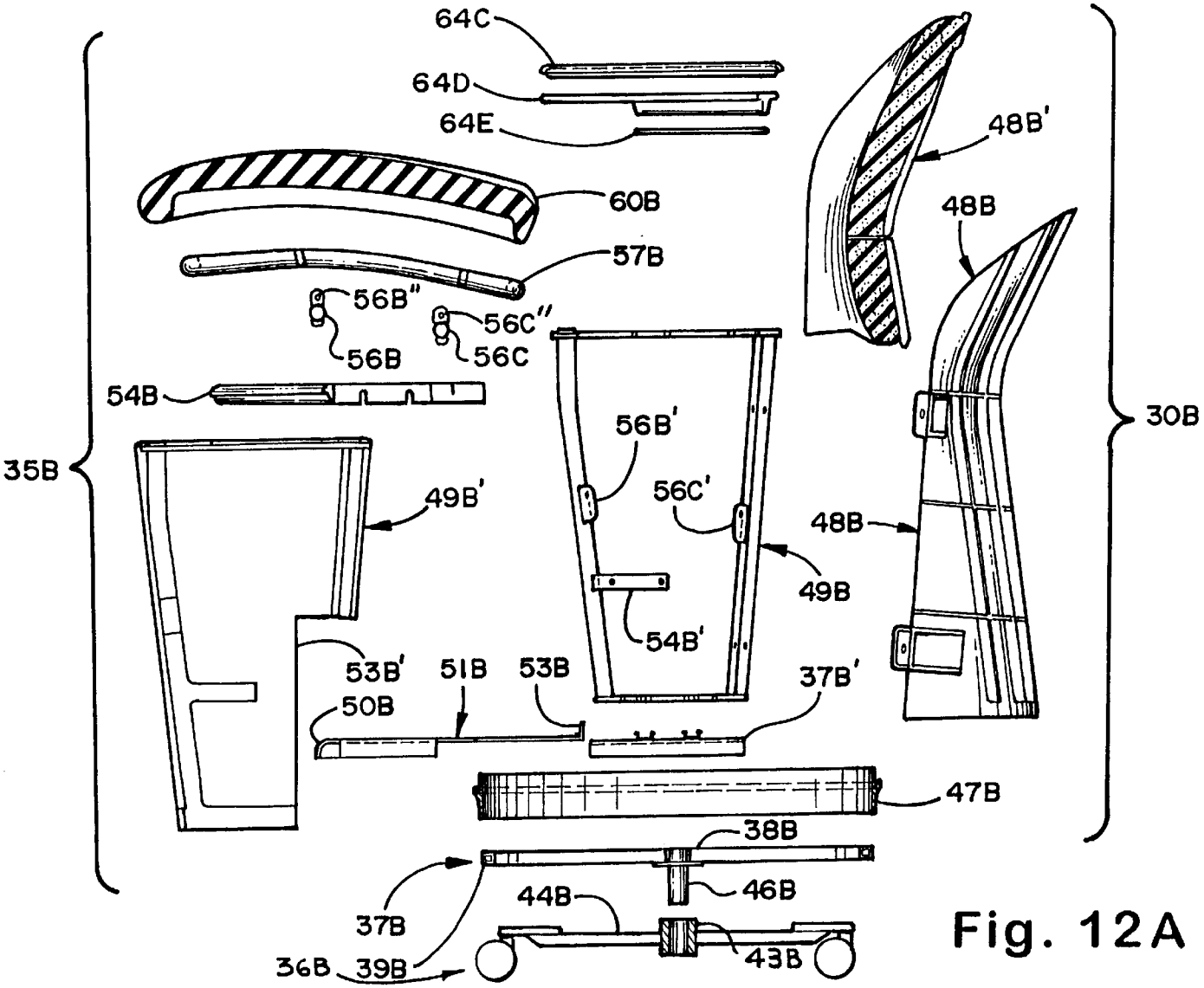
FIG. 12A is an exploded view of a second modified chair embodying the present invention.

A second modified chair 30B (FIG. 12A) includes components similar to chair 30. However, chair 30B includes a modified seat assembly 35B and a modified base 36B. Seat assembly 35B includes a circular bottom frame 37B having a center piece 38B, an outer ring 39B, and radially extending spoke-like reinforcements for supporting the ring 39B on the center piece 38B. Braces are included to rigidify the reinforcements. Base 36B includes a hub 43B with radially extending legs 44B adapted to support castors on their ends. A protrusion 46B extends downwardly from center piece 38B for engaging a hole in hub 43B. A skirt 47B attaches around outer ring 39B and drapes downwardly around the base 36B.

Seat assembly 35B is generally barrel-shaped, and includes a semi-cylindrical back shell 48B molded from structural plastic and a foam piece 48B' that attaches to an inside of shell 48B. A pair of opposing armrest-forming sides is formed from steel subframes 49B and a pair of inner cushions 49B' attached inside of subframes 49B. A platform support or cross brace 37B' attaches to bottom frame 37B. Platform support 37B' optionally includes fasteners such as hooks for snap attachment of bottom shelf 51B. Bottom shelf 51B includes a cascading front lip 50B adapted to function as a footrest and a back lip 53B forming a back wall to the shelf. A mid-height shelf 54B is adapted to attach to the inside of back and side components 48B and 49B, such as at bracket 54B' on side subframe 49B. Transverse brackets 56B and 56C attach between side shells 49B at brackets 56B' and 56C' for supporting a seat frame 57B and a seat cushion 60B. Seat frame 57B is attached to brackets 56B' and 56C' at flanges 56B" and 56C". Armrests are formed by opposing half members 64C and 64D attached to a reinforcement plate 65E, plate 65E being previously attached to a top of side shell 49B. It is contemplated that different height and width shells 48B and cushions 48B' can be constructed for supporting persons having different body sizes.

Figure 9:
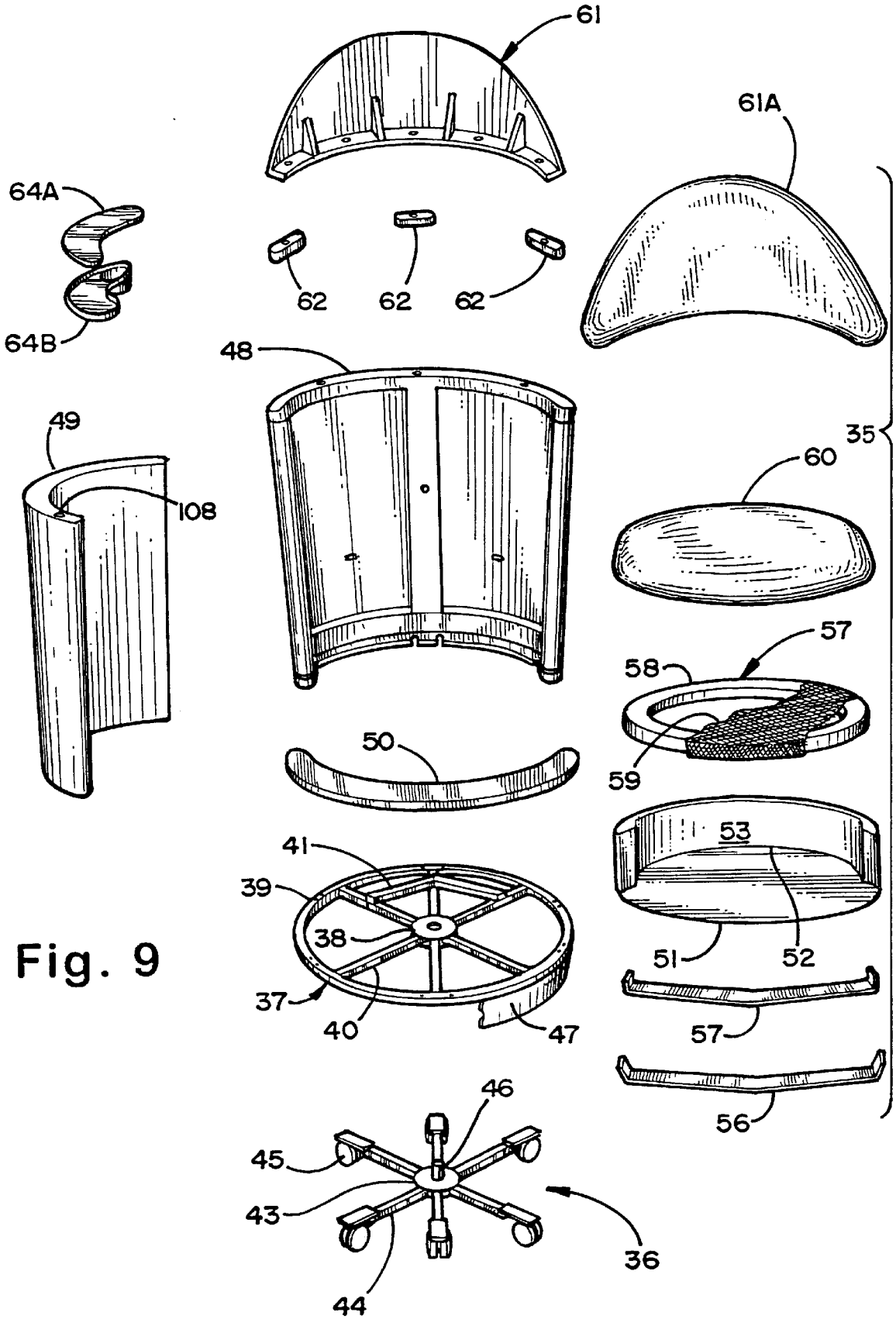
FIG. 9 is an exploded view of the chair of FIG. 1, not including the tablet.
Figure 10:
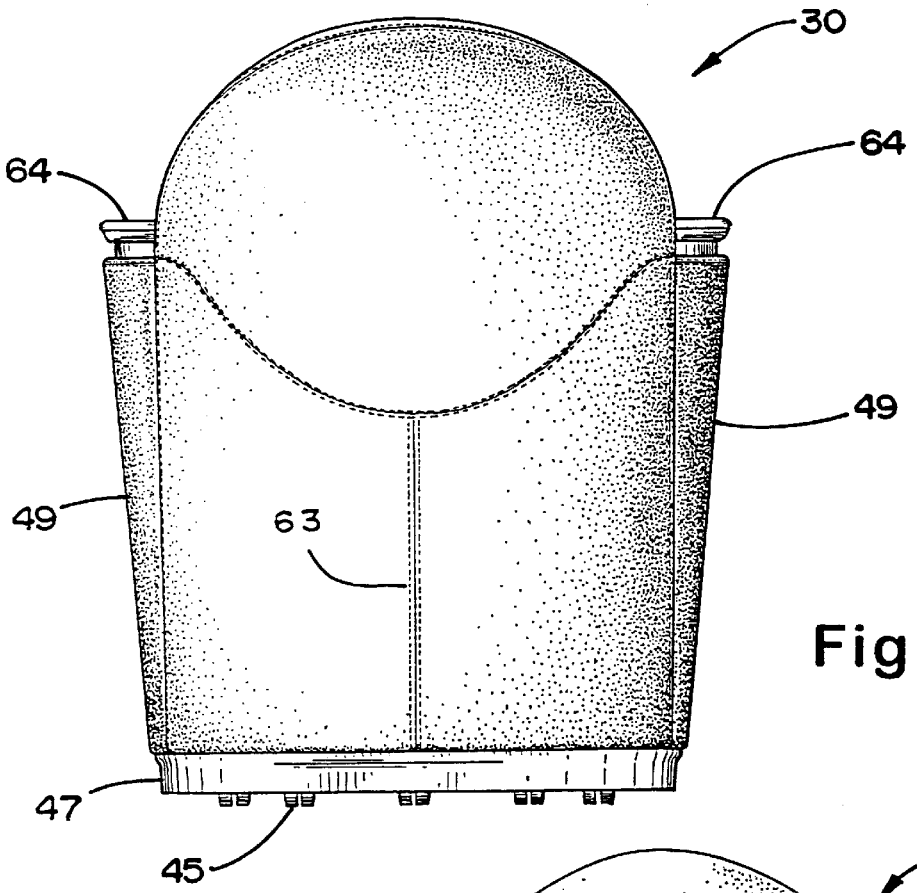
FIG. 10 is a rear view of the chair shown in FIG. 1.
Figure 14:
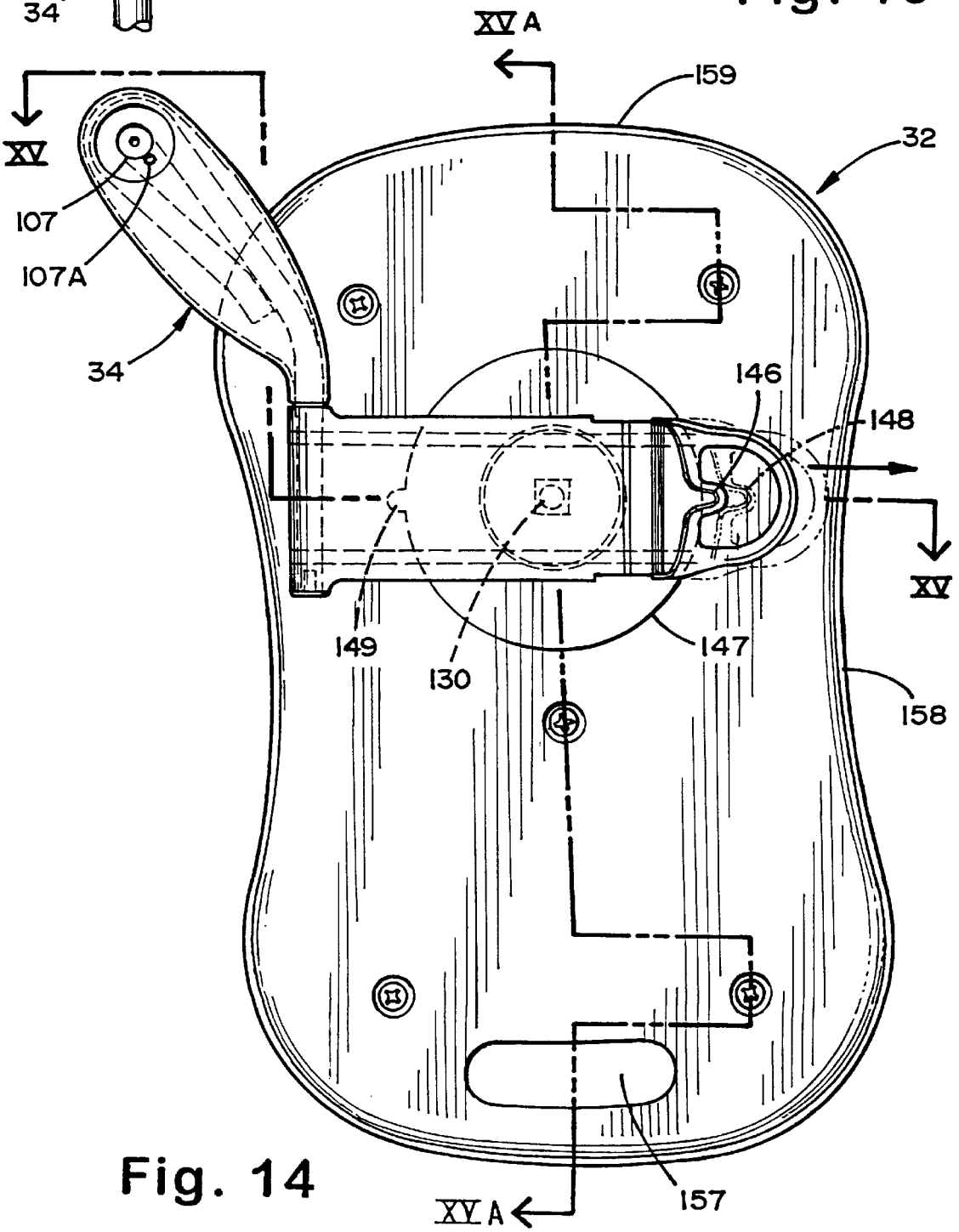
FIG. 14 is a bottom view of the tablet shown in FIG. 1.
Figure 15A:
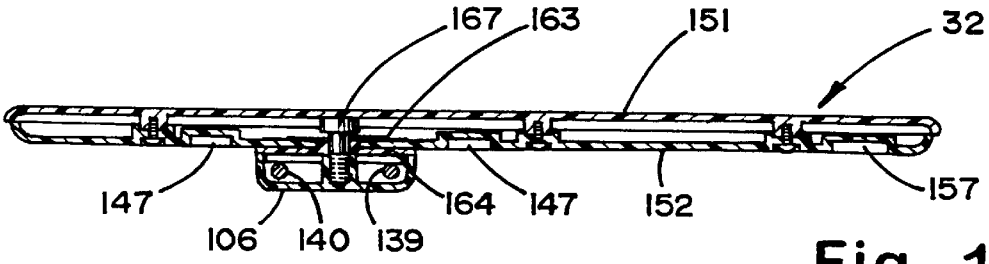

Support arm 34 (FIG. 14) is particularly adapted to securely support tablet 32, yet to permit the articulated movement of tablet 32 between various horizontal use positions (FIGS. 4 and 6), and to the vertical storage position (FIG. 13) wherein the tablet 32 is stored vertically adjacent a side of chair 30. Support arm 34 (FIG. 16) includes a weldment 105 and a pivot member 106. Weldment 105 includes a vertical rod section 107 for pivotally engaging a hole 108 in a top of side frame 49 (FIG. 9). A stop 107A (FIG. 14) is welded to a side of vertical rod section 107. The stop 107A is constructed to engage ends of a groove in armrest plate 64E (FIG. 12A) to limit the rotation of tablet 32. For example, it is contemplated that the stop 107A will limit the rotation of tablet 32 so that tablet 32 is horizontally movable between a side position where it does not undesirably hit the side of chair 30 and movable to a front position where it does not undesirably swing into and hit a person sitting in chair 30. Weldment 105 (FIG. 16) further includes a bent rod 109 with a looped end 110 looped around and welded to rod 107, and with a straight end 111 extending from the looped end 110. Top and bottom trim covers 112 and 113 cover opposing sides of the looped end 110 in a sandwich-like arrangement. The covers 112 and 113 include apertures and mating bosses for receiving screws to secure the covers together. Also, an end cap 113A (FIG. 17) engages a top end of vertical rod section 107 for securely rotatingly holding the cover 112. The straight end 111 of bent rod 109 includes three transverse holes 114, 115 and 116 spaced from its tip, and a longitudinally extending hole 117 in its tip.

Pivot member 106 includes a rod-receiving end section 120 with a bore 121 therein for rotatingly receiving the straight end 111. A slot 122 is formed in the end section 120. A retainer/clip 123 is extended through slot 122 into center hole 115 to secure pivot member 106 to rod end section 111. A trim button is extended through end hole 121 into engagement with axial hole 117 in the end of rod end section 111. The trim button includes an enlarged head providing an attractive appearance. Notably, the button can also be threaded and/or structured for holding the pivot member 106 on rod end section 111.

A pair of holes 124 and 125 are formed in rod-receiving end section 120, the holes being alignable with holes 114 and 116 in bent rod 109. Pivot member 106 includes tablet-engaging end section 126 attached to rod-receiving end section 120 by a body panel 127. Reinforcement ribs 128 and 129 extend along the edges of body panel 127 for rigidifying the pivot member 106. A pivot hole 130 is formed in tablet-engaging end section 126, and a boss-like sleeve 131 is formed around the pivot hole 130 to stabilize the pivot pin extended through the hole 130. A circular rib 132 is formed around sleeve 131, and connected to the sleeve 131 by radiating ribs 133. Secondary stabilizing ribs 134 and 135 are formed on body panel 127 transverse to edge-located ribs 128 and 129. Aligned holes 136 and 137 are formed in the ribs under body panel 127, the holes 136 and 137 aligning with holes 114 and 116 in the rod-receiving end section 120.

A pair of identical latch rods 139 and 140 are attached to a handle 141, and extend from handle 141 through holes 136 and 137, respectively, and also through holes 114 and 116, respectively, into the holes 114 and 116 in bent rod 109.

A spring 139A (FIG. 17) is positioned on rod 139 (and another spring on rod 140). As assembled, spring 139A is compressed between a washer 139B attached to rod 139 and the reinforcement rib 128, such that it biases latch rod 139 (and rod 140) to a normally extended/latched position. Handle 141 includes a grip loop 142 and further includes a configured section 143 with ribs 144 adapted to frictionally engage the ends of latch rods 139 and 140. Alternatively, a key can be used to retain the latch rods 139 and 140 to handle 141. Configured section 143 also is shaped to slidably engage the tablet-engaging end section 126 of pivot member 106 inside of outer ribs 129. This allows the handle 141 to be slid between a latched position wherein the latch rods 139 and 140 engage holes 114 and 116 in bent rod 109, and an unlatched position wherein the latch rods 139 and 140 disengage holes 114 and 116. When disengaged, the pivot member 106 (and tablet 53) can be pivoted between a tablet-horizontal side use position (see FIG. 6) and a tablet-vertical storage position (see FIG. 13). A protrusion 146 extends from handle 141 upwardly for engaging a track 147 on the underside of tablet 32. The track 147 (FIG. 14) comprises a depression that extends circumferentially around the pivot hole 130. The track 147 receives and engages the protrusion 146 to prevent the handle 141 from being moved when the tablet 32 is rotated out of the storage position on the tablet 34. The track 147 includes a recess 148 for receiving the protrusion 146 when the tablet 32 is in the storage position, thus allowing the handle 141 to be moved to release the latching rods 139 and 140 only at a predetermined time for moving the tablet 34 to the storage position. In other words, in most positions of the tablet 32 in front of chair 30, the latch cannot be released. The latch is designed to be inoperable when the tablet 32 is positioned in the most regularly used positions in front of chair 30. Notably, the track 147 includes a second recess 149 positioned on an opposite side of the tablet 32 so that the same tablet 32 can be used on either the right armrest or left armrest of the chair 30. Latching rods 139 and 140 can be held in the latched position by various means, such as by the bias spring 139A operably engaged between the handle 141 and the pivot member 106, or by detents on the handle 141 and on the pivot member 106.

Tablet 32 (FIGS. 17 and 18) includes upper and lower plates 151 and 152 having edge flanges 153 and 154 adapted to matingly engage, with the upper edge flange 153 being slightly outboard of the lower edge flange 154 for aesthetics. The upper plate 151 includes attachment bosses 155, and the lower plate 152 includes bosses 156 for receiving the tips of bosses 155. Screws are extended through lower bosses 156 into upper bosses 155 to secure plates 151 and 152 together. Lower plate 152 includes a finger recess 157 at one end to facilitate grasping the tablet 32 to manipulate the tablet 32. The outer perimeter of tablet 32 defines a generally rectangularly shaped perimeter, but with generously radiused corners connecting concave long sides 158 (FIG. 14) and outwardly curved convex short sides 159. The concave long sides 158 are gently curved, and are shaped to closely match the shape of at least a portion of tabletop 33, as discussed below.

The lower plate 152 is particularly adapted to be rotatably mounted to the tablet-engaging end section 126. For this purpose, the lower plate 152 (FIG. 18) includes a pivot hole 160 and a reinforcement rib 161 extending around pivot hole 160. A pattern of angled and orthogonal ribs 162 extend from the edges of lower plate 152 to the track 147 and further rigidify the plate 152. Upper and lower stiffening disks 163 and 164 are positioned on opposite sides of lower plate 152, and each include a pivot hole 165 and 166, respectively, that align with pivot hole 160. A pivot pin 167 includes a fender washer 167A and a shaft 167B that extends through pivot holes 165, 160, and 166, and is rotatably secured in pivot hole 130 in pivot member 106. Notably, pivot pin 167 does not extend through top plate 151, but instead is installed before upper plate 151 is attached to lower plate 152.

Figure 17:
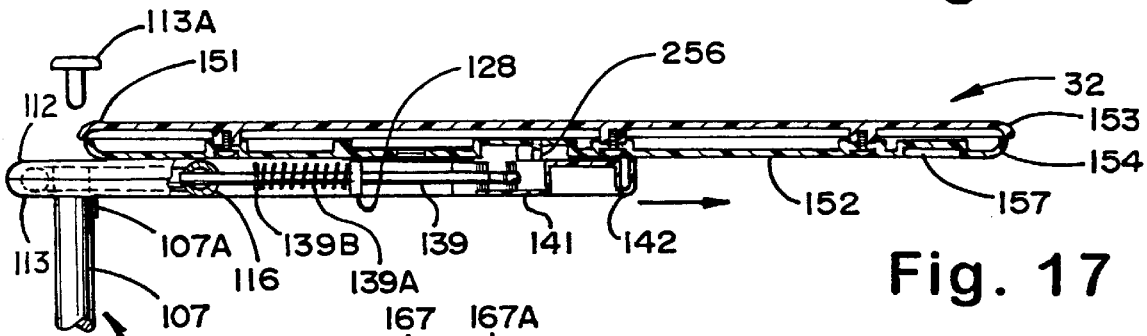
FIG. 17 is a cross-sectional view of the tablet similar to FIG. 15A, but with the tablet being rotated 90 degrees relative to the support arm before taking the cross section.
Figure 18:
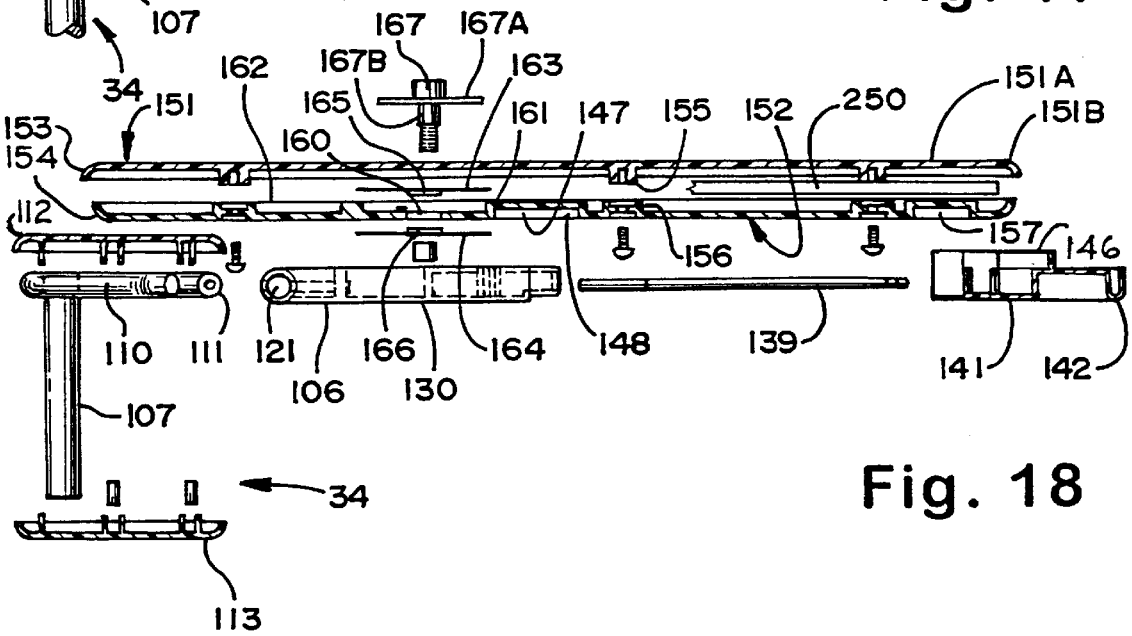
FIG. 18 is an exploded view of the tablet shown in FIG. 17, including a reinforcement member.

To assemble tablet 34 to chair 30, stiffening disks 163 and 164 are sandwiched about lower plate 152, and then attached to pivot member 106 (compare FIGS. 17 and 18). Thereafter, the upper plate 151 is attached to lower plate 152 by attachment screws that extend upwardly through lower plate 152 into upper plate 151. Straight rod 111 of weldment 105 is extended into the mating hole 121 of pivot member 106, and secured therein by a headed screw 123. The vertical rod section 107 of weldment 105 is extended into a pivot-forming hole 108 (FIG. 9) in a top/front of side shell 49 in an area under the front of the chair armrest (either the right or the left).

The upper plate 151 (FIG. 18) includes an inlaid upper layer of melamine laminate or other tough material optimally suited to resist scratching and marring. The material is inlaid so that its edges are protected and so that it is not easily or accidentally removable. The inlaid material can be pulled off of the tablet 32 and replaced without tearing apart the tablet 32. Alternatively, where the inlaid material is adhered so securely that it is not removable without damaging the upper plate 151, the tablet 32 can be disassembled and the entire upper plate 151 replaced. It is noted that the inlaid material also can be a wood inlay, or wood simulating inlay, or can be an aesthetically colored plastic, such that a distinctive tablet and chair results.

In a preferred embodiment, a tablet arm support insert 250 (FIGS. 18A and 18B) is inserted between upper and lower plates 151 and 152 (FIG. 18) to stiffen the tablet assembly. Insert 250 (FIGS. 18A and 18B) includes side rods 251 connected by a cross plate 252 at one end. Side rods 251 can be located inboard or outboard of the attachment bosses 155 and 156. Cross plate 252 includes a circular depression 253 that mateably fits into the pocket formed by rib 61 (FIG. 18) formed around pivot hole 160. A pair of holes 254 and 255 are formed in cross plate 252. The hole 254 is adapted to receive a stop screw 256 (FIG. 17) that engages sides 128 or 129 to limit the rotation of tablet 32 about pivot 130. The rotation of tablet 32 is limited so that the tablet 32 naturally rests in a square front position (see FIG. 28) in front of chair 30. The hole 254 is used when the tablet 32 is attached to a right armrest, and the hole 255 is used when the tablet 32 is attached to a left armrest of chair 30.

Figure 18D:
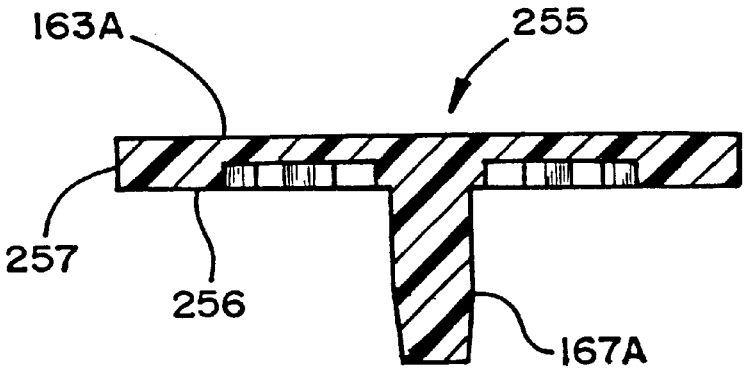
FIG. 18D is a cross-sectional view taken along the line XVIIID—XVIIID in FIG. 18C.
Figure 18C:
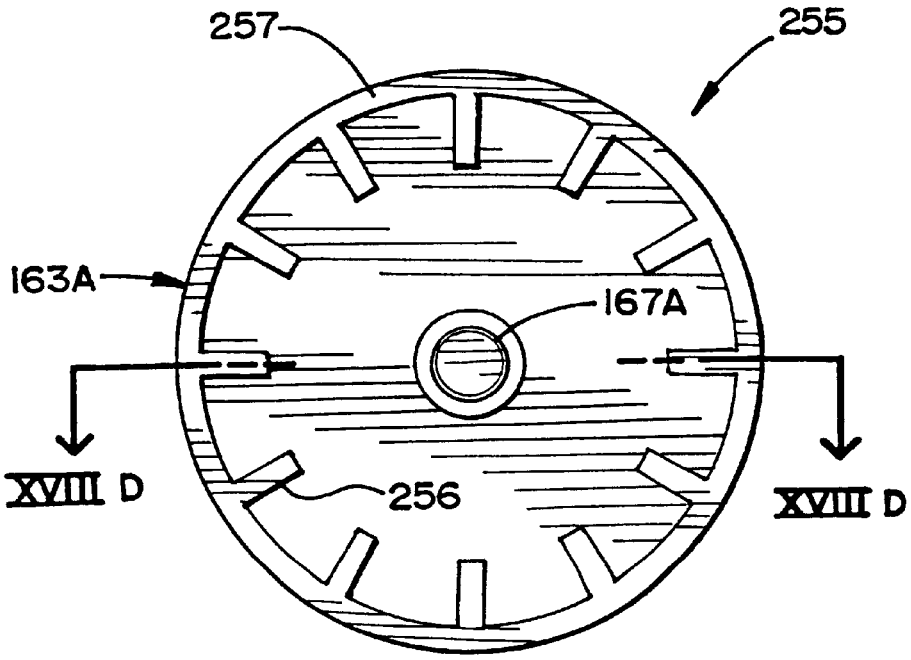
FIG. 18C is a plan view of a pivot member including an integral stiffening disk and pivot pin.
Figure 19:
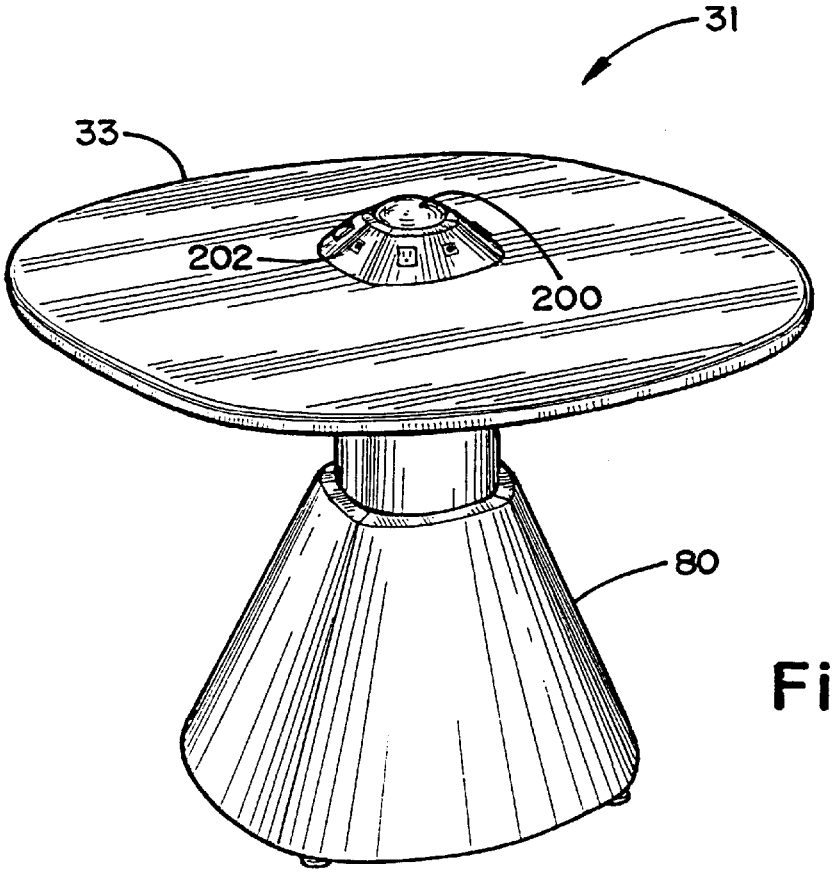
FIG. 19 is a perspective view of a table embodying the present invention, the table being adapted to interface with the tablet of the chair.
Figure 20:
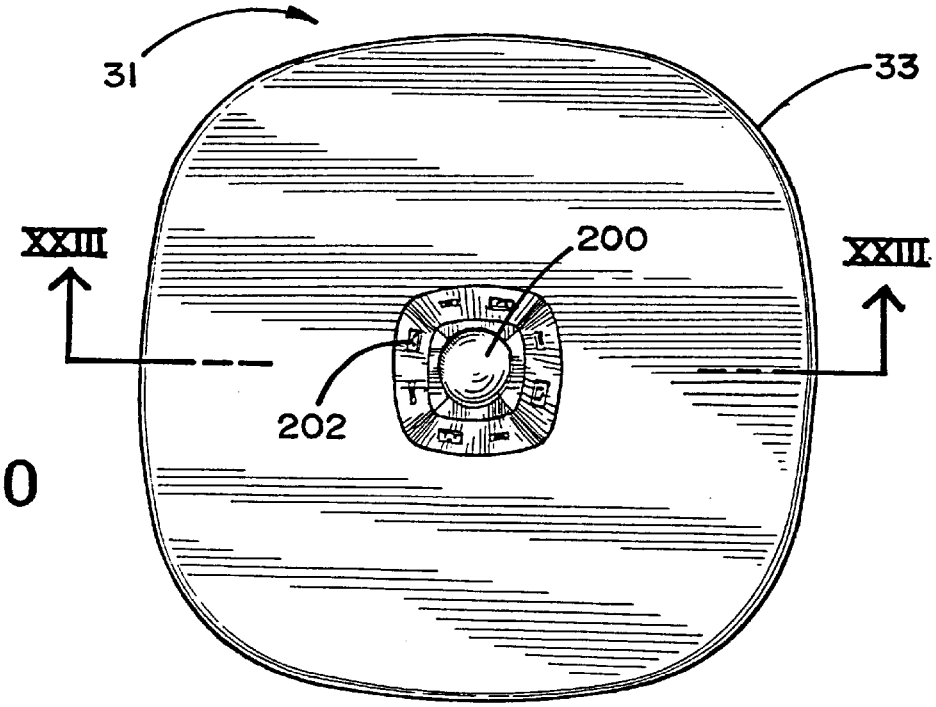
FIG. 20 is a top view of the table shown in FIG. 19.
Figure 21:
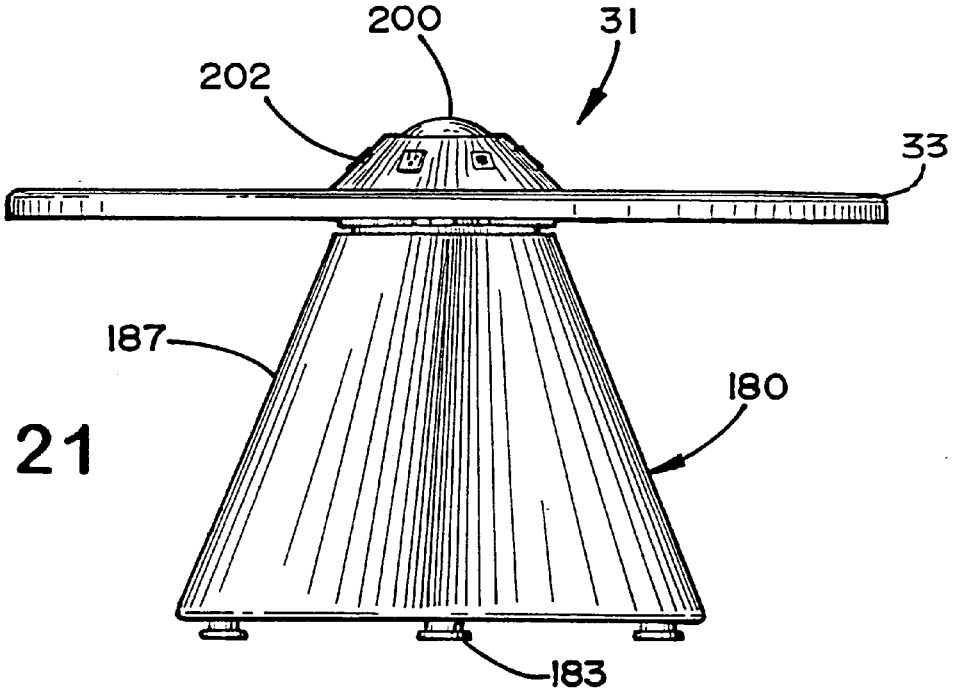
FIGS. 21 and 22 are side views of the table shown in FIG. 19, FIG. 21 showing the tabletop in a lowered position, and FIG. 22 showing the table in a raised position.
Figure 22:
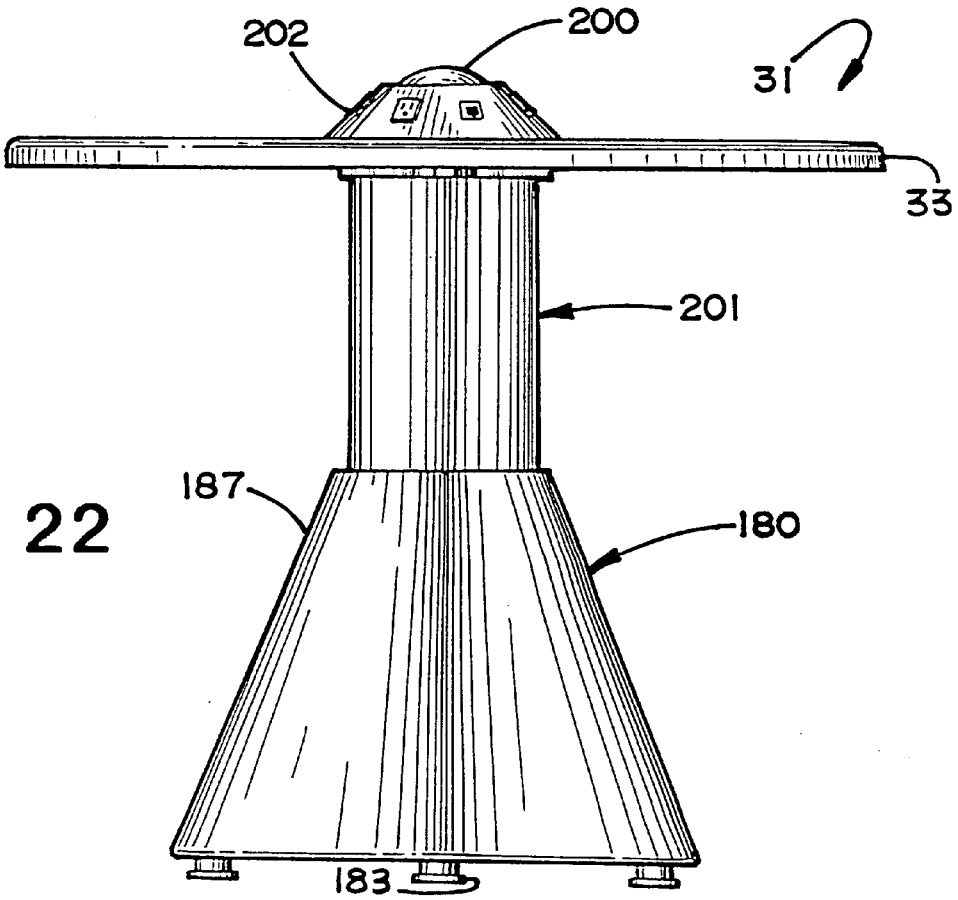

The tablet assembly 32 is stiffened by incorporating the disk-like fender washer 167A (FIG. 18) into the bolt 167. Alternatively, a tablet arm top cap 255' (FIGS. 18C and 18D) is provided that replaces bolt 167 and that includes a stiffener disk portion 163A and a pivot pin portion 167A. Radial ribs 256 stiffen a circular perimeter flange 257 on disk portion 163A.

Table 31 (FIG. 24) includes a geometrically shaped base 180 and a vertically extendable tabletop assembly 181 including tabletop 33. Base 180 includes an X-shaped bottom frame 182 having feet 183 on the ends of its legs 184, and a center piece comprising a plate 185 for rigidity and a pocket forming cup 186. A geometrically shaped pyramid-like shell 187 is attached to bottom frame 182, and extends upwardly. The shell 187 has an open top that is generally square but with rounded corners. A gas spring or lift assist 189 includes a cylinder 190 and an extendable rod 191. The lower end of rod 191 fits mateably into the pocket of cup 186. The upper end of cylinder 190 extends above the top of shell 187. A release button 192 is located on the upper end of cylinder 190, and extends upwardly.

Figure 23:
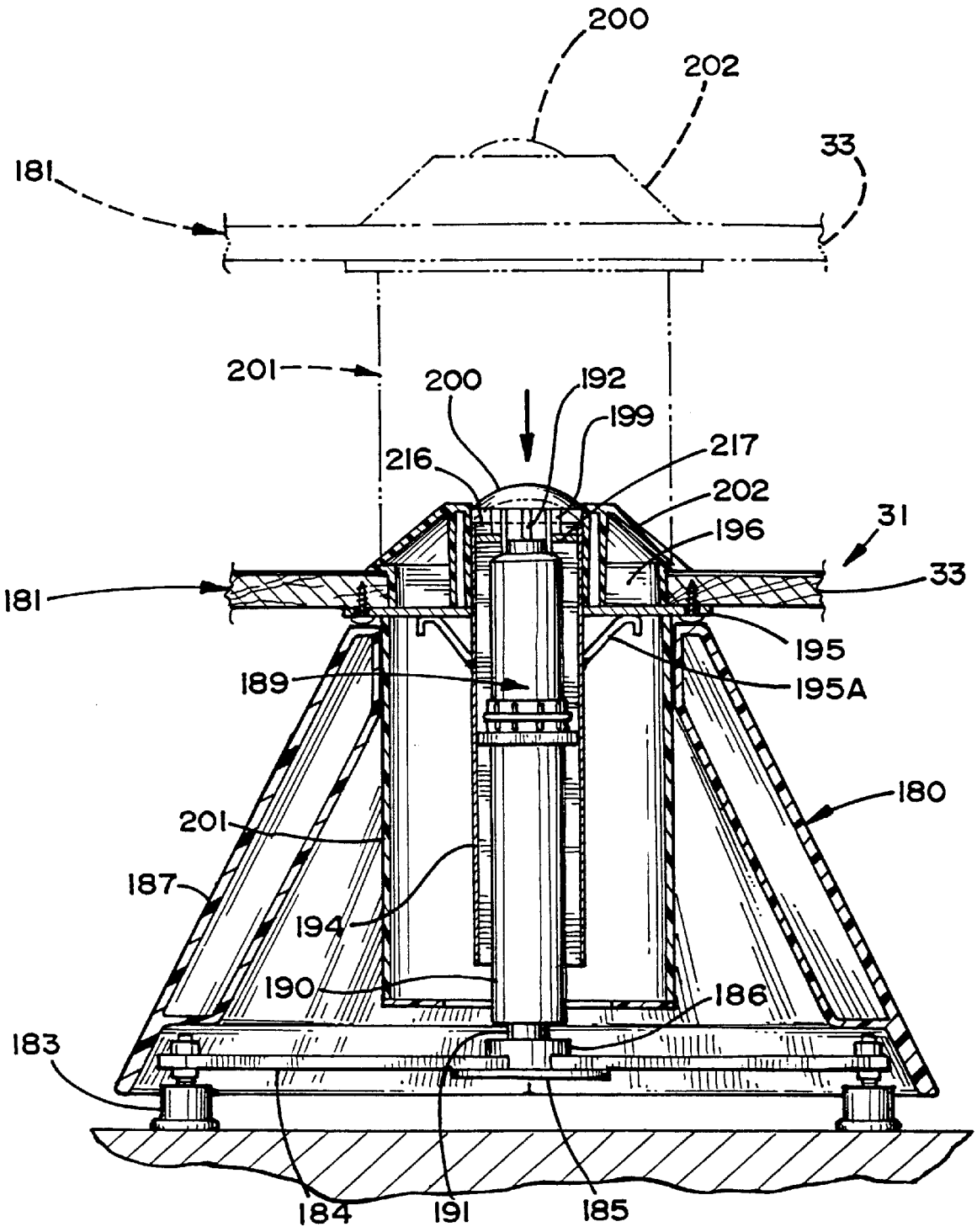
FIG. 23 is a cross-sectional view taken along the plane XXIII—XXIII in FIG. 20, the table being shown in solid lines in the lowered position and in phantom lines in the raised position.

Tabletop assembly 181 (FIG. 24) includes a tabletop support 230 having a center tube 194 and having a plurality of arms 195 for supporting tabletop 33 that extend laterally from an upper portion of center tube 194. The illustrated arms 195 form an X-shaped pattern, although alternative shapes are contemplated. The tabletop 33 includes a center aperture 196 that receives an upper portion of the center tube 194, such that the tabletop 33 rests on the arms 195. The tabletop 33 is secured to arms 195 by screws or the like (FIG. 23). Notably, the tabletop 33 can be any of a variety of different sizes and contours. A particularly advantageous tabletop shape is contemplated to be a generally rectangular top with radiused corners and generously radiused long edges, the generously radiused convex long edges having a shape chosen to match the long concave edges on the tablet 32. In particular, a tabletop having a width somewhat greater than the long dimension of the tablet 33 is found to be particularly useful and efficient to work with.

Figure 24:
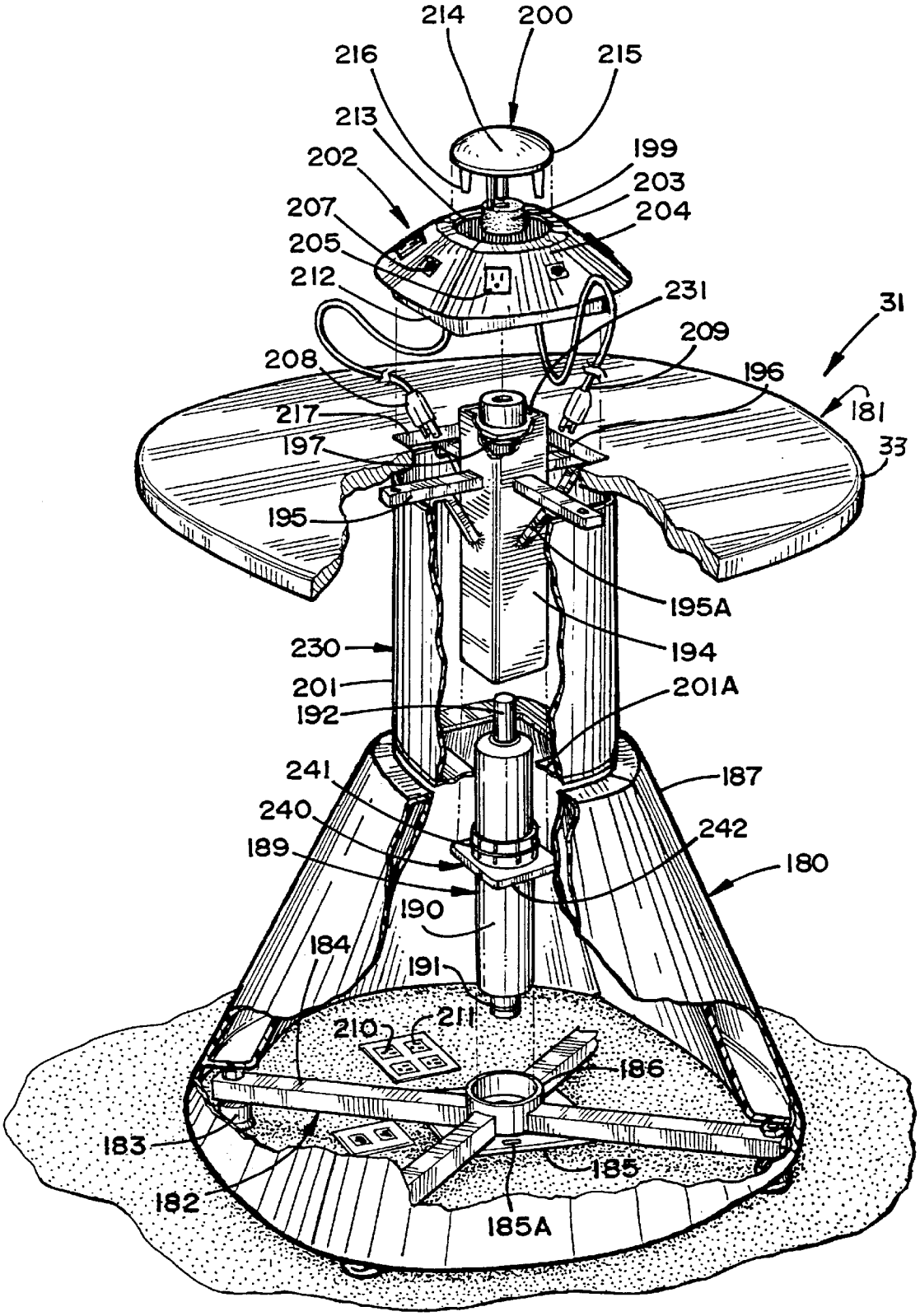
FIG. 24 is a perspective view of the table shown in FIG. 19, the table being partially broken away to expose internal components therein and being shown in a raised position.
Figure 24A:
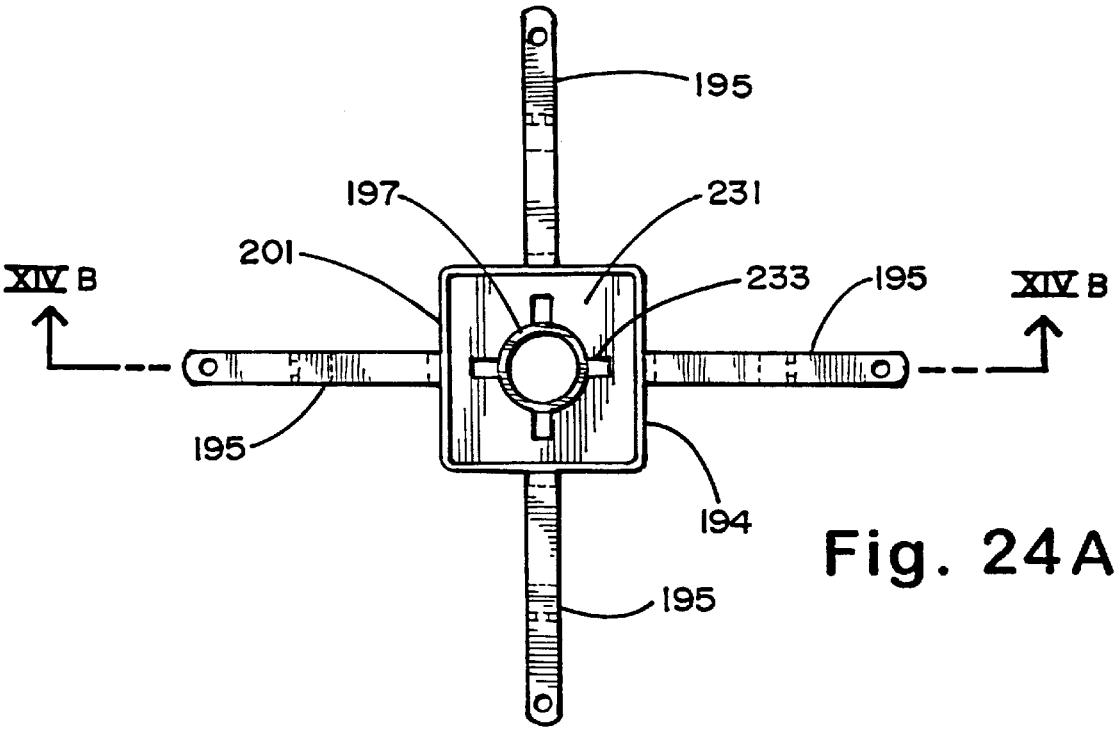
FIGS. 24A and 24B are top and side views of the tabletop support shown in FIG. 24, FIG. 24B being a cross-sectional view taken along the line XXIVB—XXIVB in FIG. 24A.
Figure 24B:
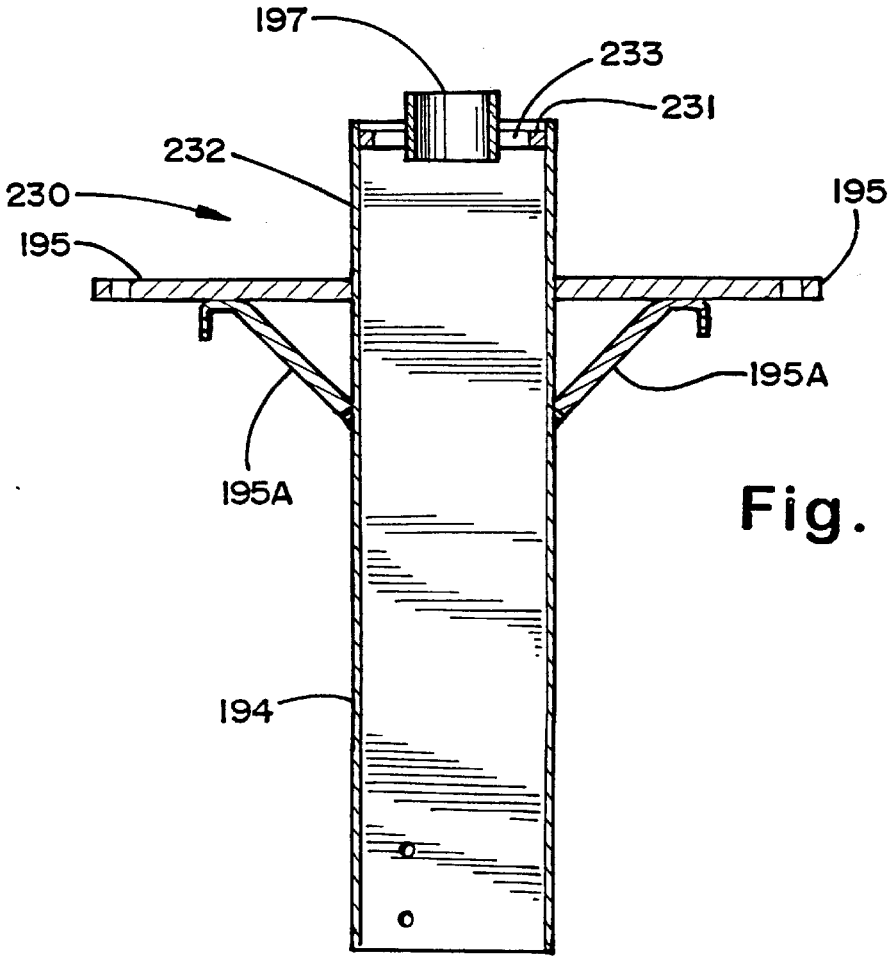

The tabletop support or "attachment spider" 230 (FIGS. 24A and 24B) is configured stable and telescopingly supports tabletop 33 on base 180. Support 230 includes the center tube 194 and a ring 197 supported near a top of tube 230 in the center thereof by reinforcement plate 231. Tube 230 is adapted to telescope into the aperture at the top of base shell 187 (FIG. 24). A bushing 240 is attached to gas spring cylinder 190 by a hose clamp 241 that wraps around and tightly squeezes bushing 240 to frictionally engage bushing 240 on cylinder 190. Bushing 240 includes a rectangle plate-like lower portion 242 that slidably mateably engages an inside of rectangular tube 194 to stabilize tabletop assembly 181. An upper portion 232 extends above arms 195 at a height just below a top of the pyramid-shaped shell 203 (FIG. 24) of utility module 202. Plate 231 (FIG. 24B) includes slots 233 for receiving the leg/guides 216 (FIG. 24) of actuator push button 200. Further, ring 197 is adapted to engage an upper end of actuator gas spring 189 (FIG. 24). Resilient washer 199 (such as a resilient foam) rests on ring 197 and operably positions push button 200 immediately over release button 192 of the gas spring 189.

A generally rectangular shell 201 is attached to the bottom of the arms 195 and extends downwardly telescopingly and matingly into the open upper end of the bottom shell 187. The bottom of shell 201 includes an inwardly extending flange 201A adapted to stabilize the lower part of the shell 201 to prevent undesired distortion in the shell. The inner edge of flange 201A has clearance with the cylinder 190 of gas spring 189.

A utility module 202 (FIG. 24) is adapted to cover the center aperture 196 in tabletop 33. The utility module 202 includes a pyramid-shaped shell 203 having four angled sides 204 that generally correspond to the sides of the tabletop 33. The angled sides 204 can be different or, as illustrated, can be identical. The illustrated sides 204 each include a power outlet 205, such as for powering a portable computer 206 (FIG. 28), and a telephone/communication jack 207 (FIG. 24) for operably connecting the computer 206 to a telephone line. Power and communication cables 208 and 209 extend from outlets 205 and jacks 207 for operative connection to floor outlets 210 and floor jacks 211. The location of wires 208 and cable 209 can be managed by using wire ties to attach them to slots 185A in bottom plate 185 or other clips/fingers inside of shell 201. The lower edge of the shell 203 includes a lip 212 shaped to mateably engage the marginal material forming the center aperture 196. The upper end of shell 203 defines an aperture 213 for receiving the actuator button 200. Actuator button 200 includes a flat center section 214, a downwardly extending side flange 215, and four legs 216 extending from the corners of the side flange 215. The legs 216 slidingly engage holes 217 in internal ring 197 for guiding the actuator button vertically during its operation.

To raise or lower the tabletop 33, a user pushes on the actuator button 200 with enough force to compress the resilient washer 199 and to cause the actuator button 200 to release the release button 192. This unlocks the extendable rod 191, which is biased toward an extended position by the gas/spring assist components in the gas cylinder 190. If the user presses downwardly with just enough force to release the release button 192, then the tabletop assembly 181 is lifted by the force that the gas spring 189 exerts on the extendable rod 191. Contrastingly, if the user presses with a significant amount of additional downward force, the combination of the user's force and the weight of the tabletop assembly 181 causes the tabletop to be lowered. Since the actuator button 200 is in the center of the table 31 and is located in a symmetrically centered/balanced position with respect to the tabletop 33, the user only has to use a single hand to raise or lower the tabletop 33. This one-handed actuation is advantageous for several reasons. For example, adjusting the height of the tabletop is easily accomplished, and can be done even while the user's other hand is occupied. Also, the actuator button is easy to see and operate, and does not require fiddling to find the button and determine how it operates. Still further, even though the button is easily seen and easy to operate, the button is located in a position where it will not be accidentally operated, nor is it in the way.

Figures 25, 27, 28:
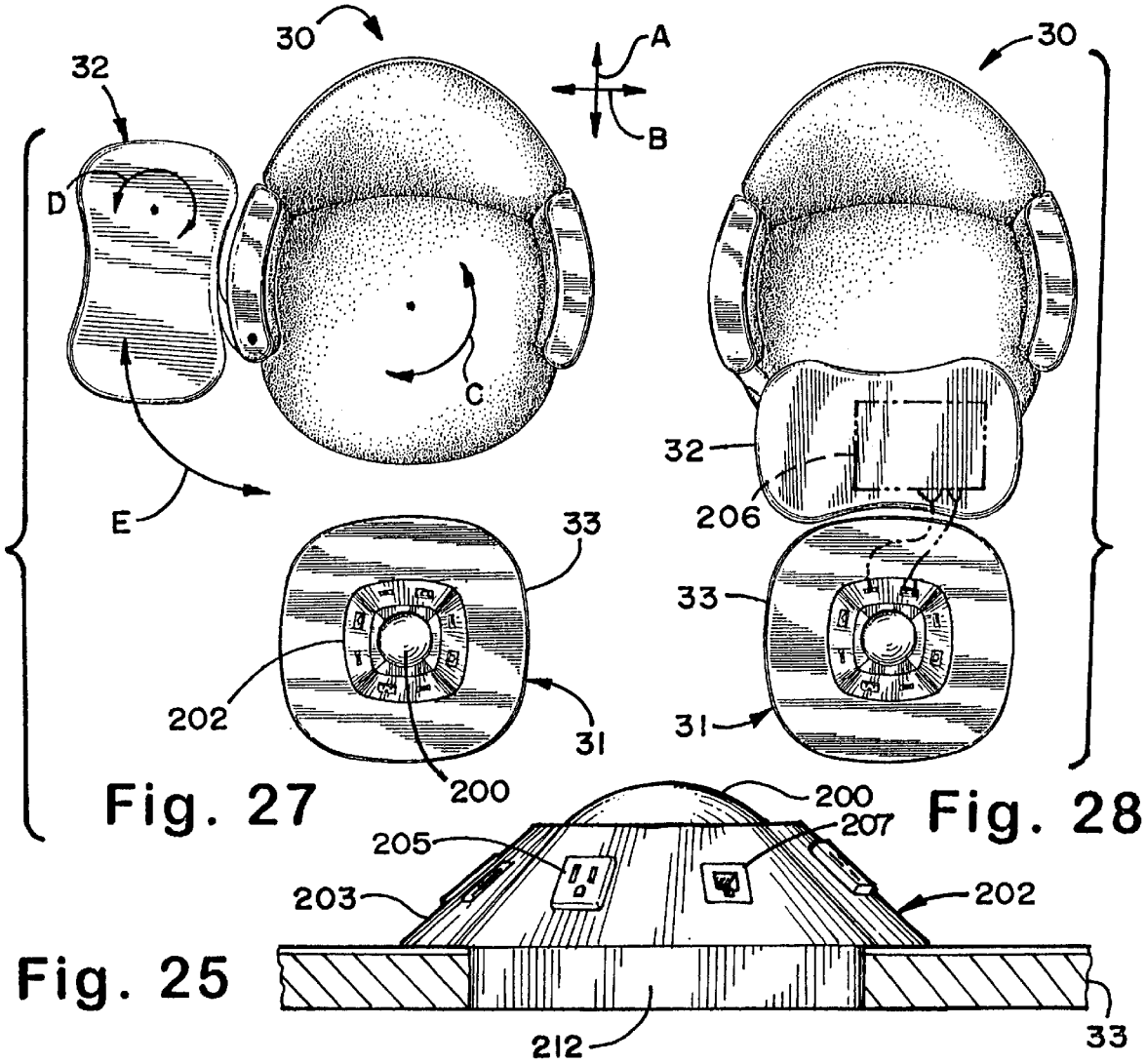
FIGS. 25 and 26 are side and top views of the utility module positioned in a center of the tabletop, FIG. 25 showing fragmentary portions of the tabletop that engage the utility module.
FIG. 27 is a plan view of the chair of FIG. 1 and the table of FIG. 19, the chair tablet being shown in a side position.
FIG. 28 is a plan view comparable to FIG. 27, but with the chair tablet being positioned adjacent and against the tabletop.
Figure 26:
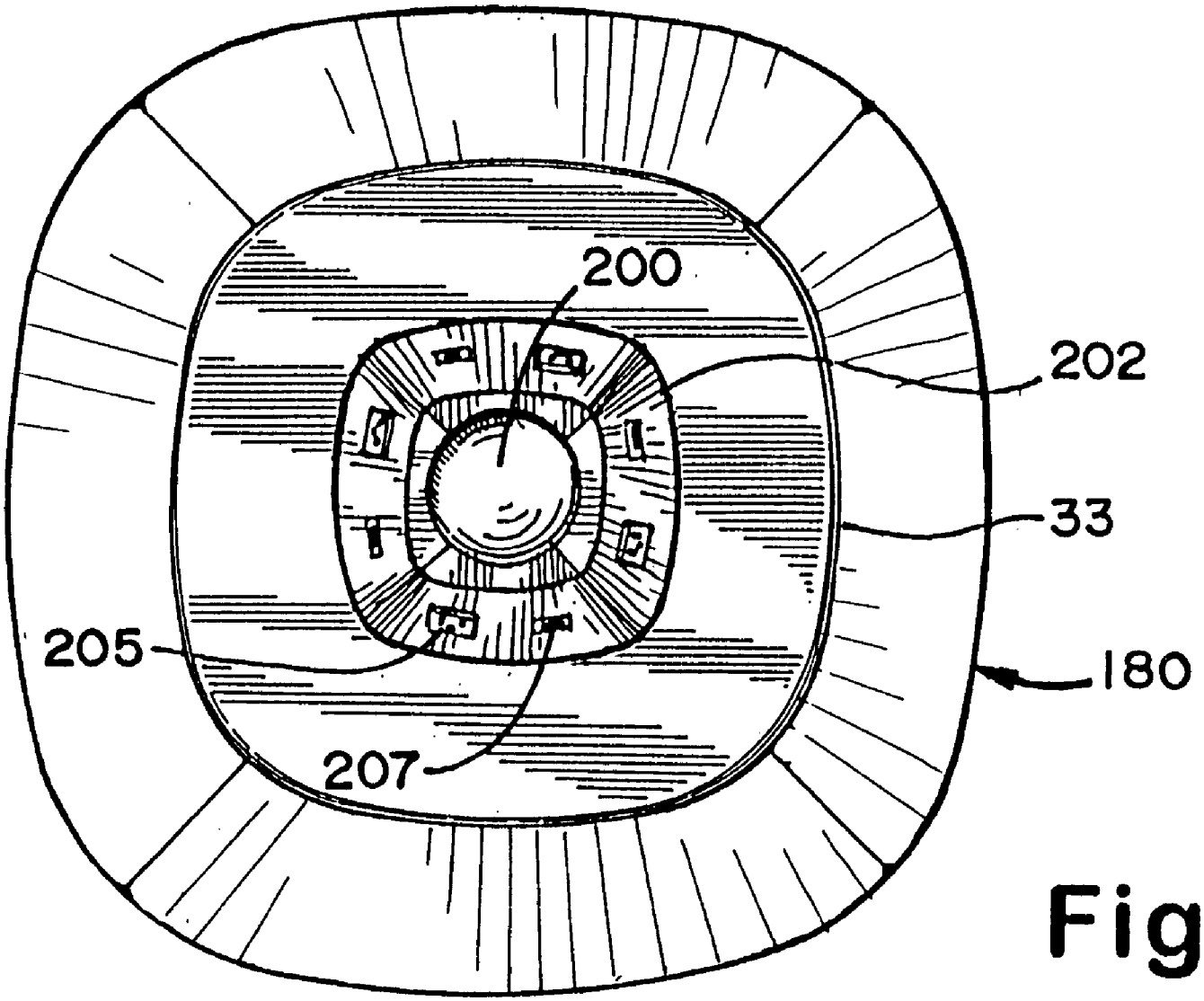

The cooperation of the chair 30 (or 30A or 30B) and the table 31 (or table 31A) is shown in FIGS. 27 and 28. The chair 30 is readily movable in a variety of directions, including linear directions A and B, but also rotationally in direction C. Also, the tablet is movable in a variety of directions, including rotationally about a first axis in direction D and rotationally about a second axis in direction E. The rotational movements D and E allow the tablet 32 to be articulated to a wide variety of positions, which positions accommodate the many different positions desired by computer users. If the user desires a larger/deeper work area, the tabletop 33 can be adjusted to an equal height with the tablet 32, and the table 31 can be positioned in front of the chair 30 with the tablet 32 abutting against a front edge of the tabletop 33 (FIG. 28). If the user desires a larger/wider work area, the tablet 32 can be rotated so that its long dimension extends forwardly generally in front of the chair armrest. Then, the table 31 is positioned generally beside the tablet 32 and in front of the chair 30. Another alternative is for a user to adjust the height of the table so that the tabletop is slightly below the tablet height. This allows the tablet 32 to be positioned closer to or even slightly over the tabletop 33. Still another possibility is for two users to move a pair of chairs 30 together in a side-by-side arrangement, with the tablet 32 located between the two chairs.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A furniture system comprising:

a chair having a tablet and a support movably attaching the tablet to the chair, the tablet being movable between various positions relative to the chair including at least one position in front of the chair; and a table having a tabletop, the tabletop having a perimeter section and the chair tablet having a contoured edge adapted to mateably interface with the perimeter section, the table including a lift assist configured to raise the tabletop, and an actuator button located in a center of the tabletop for actuating the lift assist.

2. The furniture system defined in claim 1 wherein the tablet is movable to a horizontal storage position generally beside the chair.

3. The furniture system defined in claim 2 wherein the tablet is constructed for movement between a plurality of horizontal use positions in front of the chair.

4. The furniture system defined in claim 3 wherein the tablet is horizontally translatable and also separately rotatable.

5. The furniture system defined in claim 4 wherein the contoured edge is concavely shaped.

6. The furniture system defined in claim 1 wherein the support operably supports the tablet for rotation with respect to the chair, such that the contoured edge of the tablet can be oriented and mateably engaged with the perimeter section of the table with the table located in an optimal position other than only directly in front of the chair, whereby the tablet and the table can be arranged to form a work surface offset to a customized position other than in front of the chair.

7. The furniture system defined in claim 6 wherein the table can be adjusted to locate the tabletop in a position horizontally misaligned with the tablet, so that the perimeter section of the tabletop can be overlapped with the contoured edge of the tablet.

8. The furniture system defined in claim 7 including a utility module in the tabletop having utility outlets for connection to a computer rested on the tablet.

9. A furniture system comprising:

a chair having a tablet movably attached to the chair by a support and movable between various positions relative to the chair including at least one position in front of the chair;

a table having a tabletop, the tabletop having a perimeter section and the chair tablet having a contoured edge adapted to mateably interface with the perimeter section, the support operably supporting the tablet for rotation with respect to the chair, such that the contoured edge of the tablet can be oriented and mateably engaged with the perimeter section of the table with the table located in an optimal position other than only directly in front of the chair, whereby the tablet and the table can be arranged to form a work surface offset to a customized position other than in front of the chair, the table including a leg for vertically adjusting the tabletop to a position horizontally misaligned with the tablet, so that the perimeter section of the tabletop can be overlapped with the contoured edge of the table;

a utility module in the tabletop having utility outlets for connection to a computer rested on the tablet; and a release button being operably attached to the tabletop in a center thereof.

10. The furniture system defined in claim 9 wherein the table includes a lift assist for assisting in adjusting a height of the table.

11. The furniture system defined in claim 10 including an actuator button located in a center of the tabletop for actuating the lift assist.

12. The furniture system defined in claim 1 wherein the support operably supports the tablet for rotation and translation with respect to the chair, such that the contoured edge of the tablet can be oriented and mateably engaged with the perimeter section of the table with the table located in an optimal position other than only directly in front of the table, whereby the tablet and the table can be arranged to form a work surface offset to a customized position other than in front of the chair.

13. The furniture system defined in claim 1 wherein the table can be adjusted to locate the tabletop in a position horizontally misaligned with the tablet, so that the perimeter section of the tabletop can be overlapped with the contoured edge of the tablet.

14. The furniture system defined in claim 1 including a utility module in the tabletop having utility outlets for connection to a computer rested on the tablet.

15. A furniture system comprising:

a chair having a tablet movably attached to the chair by a support and movable between various positions relative to the chair including at least one position in front of the chair;

a table having a tabletop, the tabletop having a perimeter section and the chair tablet having a contoured edge adapted to mateably interface with the perimeter section; and a release button operably attached to the tabletop in a center thereof.

16. The furniture system defined in claim 15 wherein the table includes a lift assist for assisting in adjusting a height of the table.

17. A furniture system comprising:

a chair having a tablet movably attached to the chair by a support and movable between various positions relative to the chair including at least one position in the front of the chair; and a freestanding table having a tabletop, the tabletop having a perimeter section and the chair tablet having a contoured edge adapted to mateably interface with the perimeter section, the tabletop further having a utility module having utility outlets for connection to a computer rested on the tablet.

18. A furniture system comprising:

a chair having a tablet translatably movable between a plurality of use positions by a support around a front of the chair and also separately rotatably movable to different angular orientations with respect to the chair, the table having a contoured edge; and a freestanding table having a tabletop with a perimeter section shaped to mateably engage the contoured edge so that, by positioning the chair adjacent the table with the contoured edge of the tablet engaging the perimeter section, an enlarged work surface area is formed.

19. The furniture system defined in claim 18 wherein the table includes a vertically adjustable leg that can be adjusted to locate the tabletop in a position horizontally misaligned with the tablet, so that the perimeter section of the tabletop can be overlapped with the contoured edge of the tablet.

20. The furniture system defined in claim 19 including a utility module in the tabletop having utility outlets for connection to a computer rested on the tablet.

21. The furniture system defined in claim 18 wherein the table includes a lift assist for assisting in adjusting a height of the table.

22. A method comprising steps of:

providing a chair with a movable tablet having a contoured edge;

providing a table having a tabletop with a perimeter section shaped to mateably engage the contoured edge; and moving one of the chair and table to position the tablet adjacent the tabletop including engaging the contoured edge with the perimeter section.

23. The method defined in claim 22 wherein the chair includes castors, and the step of moving including rollingly moving the chair through use of the castors.

24. The method defined in claim 22 wherein the step of moving includes rotationally and translatingly moving the tablet.

25. A furniture system comprising:

a chair having a tablet movably attached to the chair by a support and movable between various positions relative to the chair including at least one position in front of the chair; and a freestanding table, separate from the chair, having a tabletop, the tabletop having a perimeter section and the chair tablet having a non-linear contoured edge configured to mateably interfit against the perimeter section.

* * * * *